US009510989B2

(12) United States Patent
Method

(10) Patent No.: US 9,510,989 B2
(45) Date of Patent: Dec. 6, 2016

(54) ORTHOPEDIC STRETCHER

(75) Inventor: Victor Gregory Method, Park City, UT (US)

(73) Assignee: Kinex Connect, LLC, Brookfield, WI (US)

( * ) Notice: Subject to any disclaimer, the term of this patent is extended or adjusted under 35 U.S.C. 154(b) by 685 days.

(21) Appl. No.: 13/572,690

(22) Filed: Aug. 12, 2012

(65) Prior Publication Data

US 2013/0211297 A1 Aug. 15, 2013

Related U.S. Application Data

(63) Continuation-in-part of application No. 13/572,645, filed on Aug. 11, 2012, now abandoned, which is a continuation-in-part of application No. 13/053,973, filed on Mar. 22, 2011, now abandoned.

(60) Provisional application No. 61/316,095, filed on Mar. 22, 2010.

(51) Int. Cl.
*A61H 1/00* (2006.01)
*A61H 1/02* (2006.01)

(52) U.S. Cl.
CPC ..... *A61H 1/024* (2013.01); *A61H 1/00* (2013.01); *A61H 1/02* (2013.01); *A61H 1/0237* (2013.01); *A61H 2201/0161* (2013.01); *A61H 2201/12* (2013.01); *A61H 2201/123* (2013.01); *A61H 2201/1207* (2013.01); *A61H 2201/1215* (2013.01); *A61H 2201/1238* (2013.01);

(Continued)

(58) Field of Classification Search
CPC ..... A61H 1/00; A61H 1/001; A61H 1/02; A61H 1/0237; A61H 1/024; A61H 1/0244; A61H 1/0255; A61H 1/0259; A61H 1/0262; A61H 2201/12; A61H 2201/1207; A61H 2201/1215; A61H 2201/123; A61H 2205/106; A61H 2205/12; A61H 2201/1676; A61H 2201/5069; A61H 2203/045; A61H 2201/0161; A61H 2201/1642; A61H 2201/5092; A61H 2201/1253; A61H 2201/1238; A61H 2201/149
See application file for complete search history.

(56) References Cited

U.S. PATENT DOCUMENTS 2,763,261 A * 9/1956 Masmonteil ..... A61H 1/0259 601/101
2,924,214 A * 2/1960 Zak ..... A61H 1/0259 482/80

(Continued)

FOREIGN PATENT DOCUMENTS

JP 09224990 9/1997

OTHER PUBLICATIONS

International Search Report and Written Opinion for PCT/US2013/054480, mailed Nov. 20, 2013.

*Primary Examiner* — Justine Yu
*Assistant Examiner* — Tu Vo
(74) *Attorney, Agent, or Firm* — Workman Nydegger

(57) ABSTRACT

An orthopedic stretcher allows for alternately applying flexion and extension forces to a patient's leg. The orthopedic stretcher includes a base with a first leg pivotally connected thereto. A second leg support for engaging the patient's lower leg is linked to the first leg support. A first motor moves the first leg support and second leg support relative to the base, and a second motor moves the second leg support relative to the first leg support. The first motor and second motor apply an extension force or flexion force to the patient's leg to bend the patient's leg.

17 Claims, 27 Drawing Sheets

(52) U.S. Cl.
CPC . *A61H2201/1253* (2013.01); *A61H 2201/149* (2013.01); *A61H 2201/1642* (2013.01); *A61H 2201/1676* (2013.01); *A61H 2201/5069* (2013.01); *A61H 2201/5092* (2013.01); *A61H 2203/045* (2013.01)

(56) References Cited

U.S. PATENT DOCUMENTS 4,229,001 A * 10/1980 Roman ..... A63B 21/012 482/114
4,489,713 A * 12/1984 Latenser ..... 606/242
4,538,595 A * 9/1985 Hajianpour ..... A61H 1/0266 482/901
4,549,534 A * 10/1985 Zagorski ..... A61H 1/0259 601/104
4,621,620 A * 11/1986 Anderson ..... 601/34
4,665,899 A * 5/1987 Farris et al. ..... 601/33
4,671,257 A * 6/1987 Kaiser ..... A61H 1/02 482/9
4,751,917 A * 6/1988 Ruf ..... A61H 1/0259 482/8
4,825,852 A 5/1989 Genovese
4,834,073 A * 5/1989 Bledsoe ..... A61H 1/0259 601/34
5,035,233 A * 7/1991 Ruf ..... A61H 1/0259 482/148
5,280,783 A * 1/1994 Focht ..... A61H 1/0259 601/34
5,352,185 A * 10/1994 Blauth ..... A61H 1/0266 482/79
5,399,147 A * 3/1995 Kaiser ..... 601/34
5,509,894 A * 4/1996 Mason et al. ..... 601/34
5,901,581 A 5/1999 Chen
6,217,532 B1 * 4/2001 Blanchard ..... A61H 1/024 601/23
6,221,032 B1 * 4/2001 Blanchard et al. ..... 601/34
6,221,033 B1 * 4/2001 Blanchard ..... A61H 1/0255 601/23
6,267,735 B1 * 7/2001 Blanchard ..... A61H 1/024 601/23
6,962,570 B2 * 11/2005 Callanan et al. ..... 601/5
7,276,033 B2 * 10/2007 Phillips ..... A61H 1/003 601/23
7,874,968 B2 * 1/2011 Foucault ..... 482/112
2002/0045844 A1 * 4/2002 Beny ..... A61H 1/0259 601/34
2003/0154550 A1 * 8/2003 Murphy ..... A61H 1/0292 5/648
2004/0243028 A1 * 12/2004 Han ..... A61H 1/0259 601/34
2006/0064044 A1 3/2006 Schmehl
2010/0313897 A1 * 12/2010 Schaeffer ..... A61H 1/0222 128/845

* cited by examiner

ORTHOPEDIC STRETCHER

CROSS-REFERENCE TO RELATED APPLICATIONS

This is a continuation-in-part of U.S. patent application Ser. No. 13/572,645, entitled ORTHOPEDIC STRETCHER, filed on Aug. 11, 2012, now abandoned which is a continuation-in-part of U.S. patent application Ser. No. 13/053,973, entitled ORTHOPEDIC STRETCHER, filed on Mar. 22, 2011, now abandoned which claims priority to and the benefit of U.S. Provisional Patent Application No. 61/316,095, entitled ORTHOPEDIC STRETCHER, filed on Mar. 22, 2010, each of which is hereby incorporated by reference in its entirety.

BACKGROUND OF THE INVENTION

The present invention relates to devices and supports for stretching a human leg. More particularly, the present invention pertains to devices used for supporting a leg while applying flexion or extension forces of the type used for rehabilitating or exercising a knee joint.

Devices for stretching joints are commonly used by physical therapists for knee rehabilitation following injury or operation. A patient typically must undergo a physical therapy rehabilitation program for several weeks or months following such an event. During rehabilitation, the patient generally performs stretching exercises multiple times a day to develop strength and flexibility for the affected joint. Typically, a patient may undergo at least two types of knee rehabilitation exercises.

Flexion of the leg occurs by bending the knee joint to decrease the angle between the upper and lower portions of the leg. Flexion force is typically applied to a patient's leg by a physical therapist. During a flexion exercise, the patient lies face-up on a therapy table or other surface while a therapist applies force to the lower leg, bending it about the knee joint toward the upper leg. A structure may be placed under the knee to support the leg during flexion. Once the lower leg and upper leg are oriented at an optimal stretching angle, usually less than ninety degrees, the therapist then attempts to maintain the applied force and hold the leg at a static angle for a period of time, ranging from a few seconds to a few minutes. After the desired time has elapsed, the physical therapist then releases the applied flexion force in a controlled manner, and the leg is extended to a more relaxed position. This type of flexion exercise may be repeated several times during a single therapy session.

Similarly, extension exercises are typically also required for rehabilitation following a knee injury or operation. Extension of the leg occurs by straightening the leg at the knee joint, causing the angle between the upper and lower leg to increase. During an extension exercise, a physical therapist typically holds the lower portion of the leg or the foot of the patient in an elevated position while the patient lies face-up on a therapy table. The therapist then pushes the knee or upper part of the leg downward toward the table, causing the leg to straighten. When the leg is straightened to an optimal stretching angle, the therapist then attempts to statically maintain that position for a period of time. After the stretch is complete, the therapist then slowly releases the extension force applied to the leg, allowing the leg to return to a natural, relaxed position. This stretching exercise may also be repeated several times during a therapy session.

Devices for application of flexion or extension pressure to a patient's leg are known in the art. Such devices are commonly capable of providing either flexion or extension pressure, but not both. Such devices are also typically mounted to a table, and are not portable for use in a user's home. Also, rehabilitation therapy often requires a patient to visit a therapist's office several times a week. These trips can interfere with a patient's personal or work schedule and can create additional expense. A portable, easy-to-use stretching device would reduce the need for frequent visits to a therapist's office by allowing a user to perform flexion and extension exercises at home. A single portable device capable of providing both flexion and extension pressure without requiring extensive adjustment between modes is desired.

The application of flexion or extension force to the patient's leg can cause severe pain to the patient. During stretching, the therapist must communicate with the patient to avoid applying excessive force. The force feedback loop between the patient and the therapist necessarily causes fluctuation in the magnitude of applied pressure. Even minor fluctuations in the applied pressure, can detract from the rehabilitative effect of the exercise. Rapid or unsteady changes in applied force can cause injury to the patient. For optimal effectiveness, steady force application and steady force release are preferred. A device that allows the patient to control the applied force during both stretching and release is desired.

What is needed, then, is a device a patient can use at home, or a physical therapist can use in an office on a therapy table, to provide controlled application and release of flexion and extension forces for knee rehabilitation exercises.

BRIEF SUMMARY OF THE INVENTION

In an embodiment of the present invention, an apparatus for applying flexion and extension force to a leg is provided. Some features of the apparatus include a base frame having a support arm pivotally mounted thereon. The support arm can be rotated relative to the base frame. Additional support arms may also extend from the base. In one embodiment, each support arm includes a telescoping rod slidably extending from a sleeve. The telescoping rod may further include a locking feature for securing the rod in an extended or retracted position.

A rotating spool is attached to the base frame. The rotating spool includes a handle operatively attached to the spool for rotating the spool. A tension cable is wound about the spool and extends from the spool to a strap. The strap is adapted for releasably securing to the user's leg. In one embodiment, the rotating spool is mounted on a ratchet for allowing the spool to rotate in one direction while preventing spool rotation in the opposite direction. The spool may also include a switch for disengaging the ratchet mechanism.

An alternative embodiment of the present invention provides an apparatus for alternatively applying flexion and extension forces to a user's leg, the leg including an upper leg and a lower leg pivotally connected at a knee joint. The apparatus includes a base having a frame, the base including a proximal end and a distal end. A seat area is positioned at the proximal end of the base. A support arm is pivotally attached to the frame, the support arm being angularly moveable between a flexion position and an extension position. A leg support is pivotally attached to the support arm. The leg support is configurable to engage the user's upper leg when the support arm is in the flexion position. The leg support is alternatively configurable to engage the user's lower leg when the support arm is in the extension position. A mechanical actuator is attached to the frame.

In yet another embodiment of the present invention a leg stretching apparatus includes a frame and a support arm attached to the frame. The support arm is angularly moveable between a flexion position and an extension position. A leg support is pivotally attached to the support arm. A rotatable spool is attached to the frame. A cable includes a first cable end wound about the spool and a second cable end mechanically securable to the leg. Rotation of the spool causes a flexion force to be applied to the user's leg when the support arm is in a flexion position. Conversely, rotation of the spool causes an extension force to be applied to the user's leg when the support arm is in an extension position.

In still yet another exemplary embodiment of the present invention, an apparatus is provided for alternately applying flexion and extension forces to a patient's leg that includes an upper leg and a lower leg pivotally connected at a knee joint. The apparatus includes a base and a first leg support pivotally connected to the base. The first leg support engages the patient's upper leg. A second leg support is linked to the first leg support and engages the patient's lower leg. A means for applying an extension force moves the first leg support and the second leg support further apart from one another to extend the patient's leg. A means for applying a flexion force moves the first leg support and the second leg support closer together to bend the patient's leg.

In another exemplary embodiment, an apparatus is provided for alternately applying flexion and extension forces to a patient's leg. The apparatus includes a base and a plurality of support rods linked to the base. The plurality of support rods includes at least one front support rod pivotally connected to the base and a support bracket linked to the base. The at least one front support rod has a proximal end and a distal end. A first leg support is selectively securable to the patient's upper leg and is pivotally connected to the at least one front support rod. A slide is connected to the support bracket and has a proximal end and a distal end. A second leg support is selectively securable to the patient's lower leg and is movably connected to the slide. A first drive mechanism selectively moves the first leg support and the second leg support further apart from one another to extend the patient's leg. A second drive mechanism selectively moves the first leg support and the second leg support closer together to bend the patient's leg.

In a further embodiment, an apparatus is provided for alternately applying flexion and extension forces to a patient's leg is provided. The apparatus includes a plurality of support arms. Additionally, the apparatus includes a first leg support and a second leg support. The first leg support is selectively securable to the patient's upper leg and is pivotally connected to a first support arm of the plurality of support arms. Similarly, the second leg support is selectively securable to the patient's lower leg and pivotally connected to a second support arm of the plurality of support arms. In order to apply an extension force to the patient's leg, the first leg support and the second leg support both move in a first horizontal direction. Additionally, the second leg support moves further away from the first leg support. Conversely, to apply a flexion force to the patient's leg, the first leg support and the second leg support both move in a second horizontal direction. The second leg support also moves closer to the first leg support to apply a flexion force to the patient's leg.

These and other objects and features of the present invention will become more fully apparent from the following description and appended claims, or may be learned by the practice of the invention as set forth hereinafter.

DETAILED DESCRIPTION OF THE PREFERRED EMBODIMENTS

Figure 1:
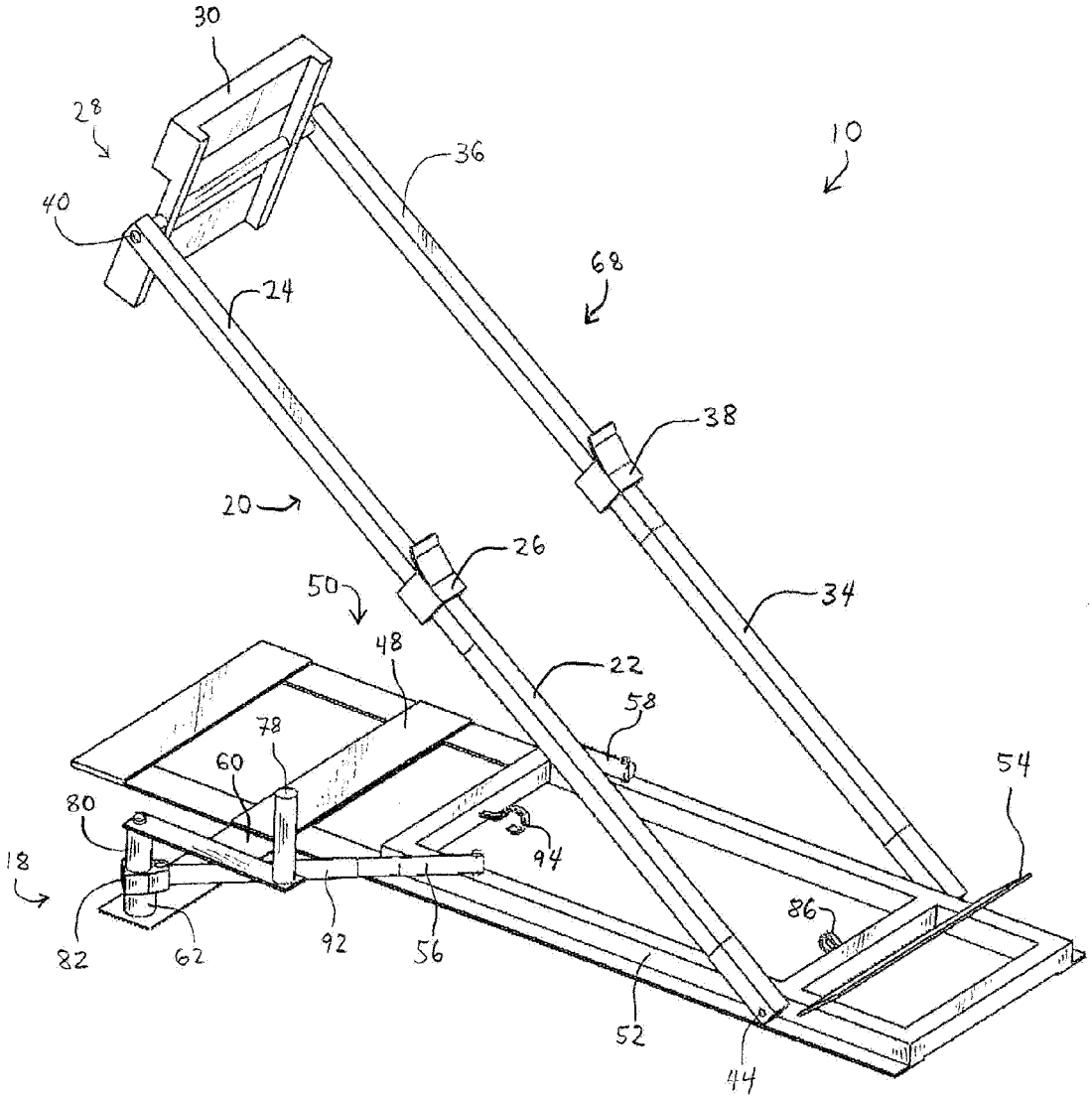
FIG. 1 is a perspective view of an orthopedic stretcher in accordance with the present invention.
Figure 2:
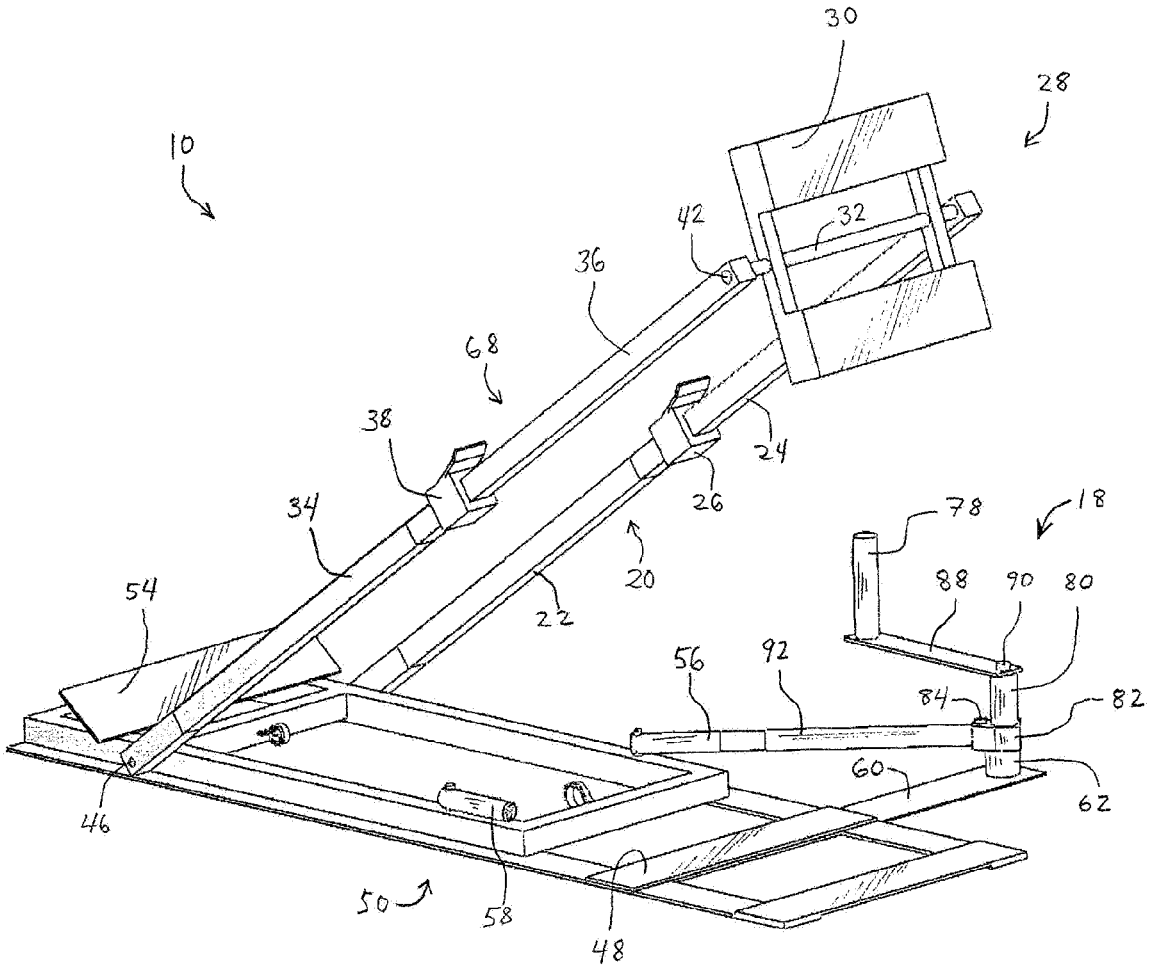
FIG. 2 is a perspective view of the orthopedic stretcher of FIG. 1.

Referring now to FIG. 1, one embodiment of an orthopedic stretcher 10 in accordance with the present invention is shown. The orthopedic stretcher 10 includes a base 50 having a frame 52. In one embodiment, the frame 52 includes metal tubing having a round or rectangular cross section. The frame 52 includes a first support arm 20 pivotally connected to the frame 52 at a first support hinge 44. A second support arm 68 is pivotally connected to the frame 52 at second support hinge 46 opposite the first support hinge 44, shown in FIGS. 1 and 2.

Figure 3:
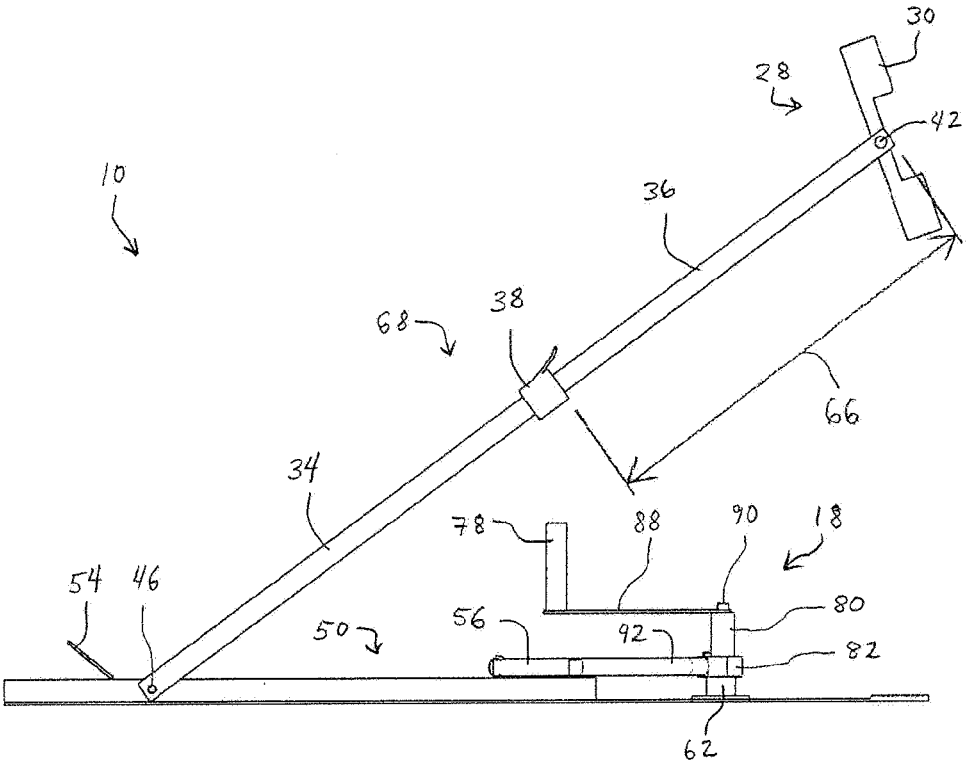
FIG. 3 is a left side elevation view of the orthopedic stretcher of FIG. 1.
Figure 4:
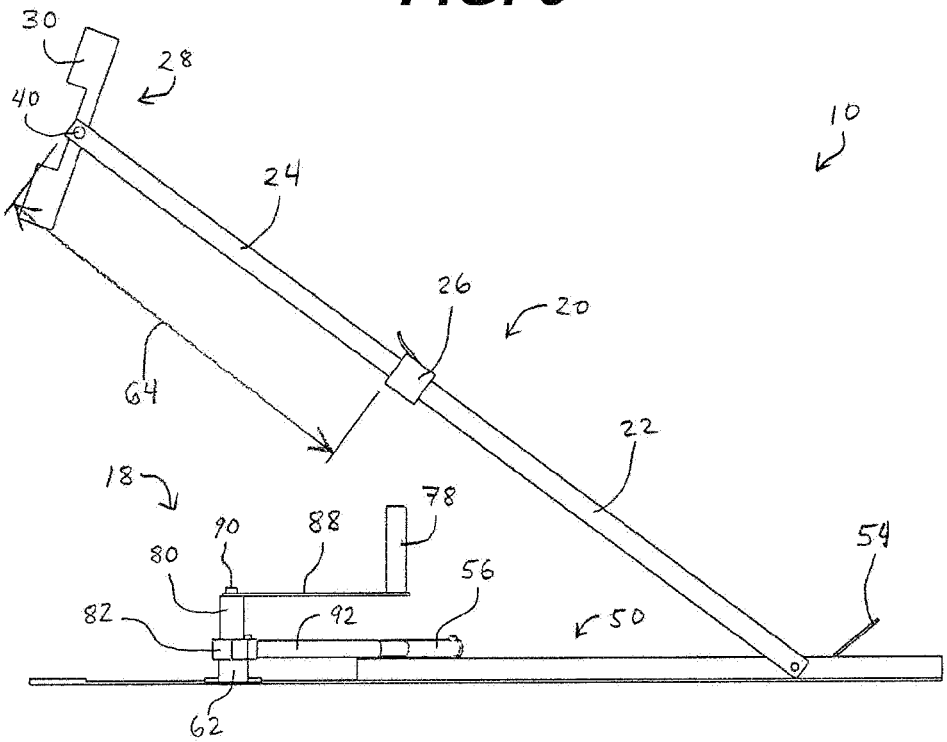
FIG. 4 is a right side elevation view of the orthopedic stretcher of FIG. 1.
Figure 5:
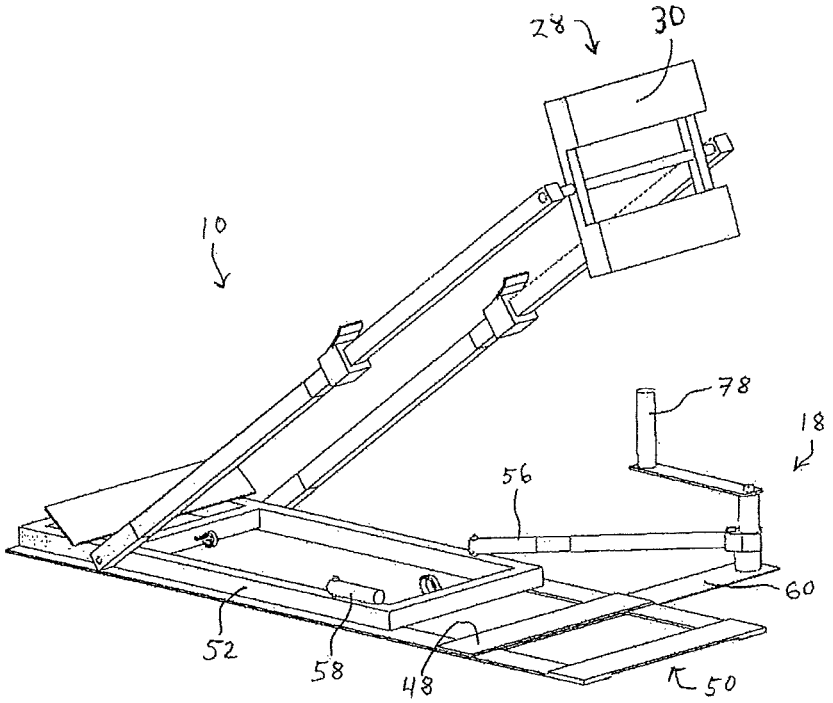
FIG. 5 is a perspective view of an orthopedic stretcher in accordance with the present invention.
Figure 6:
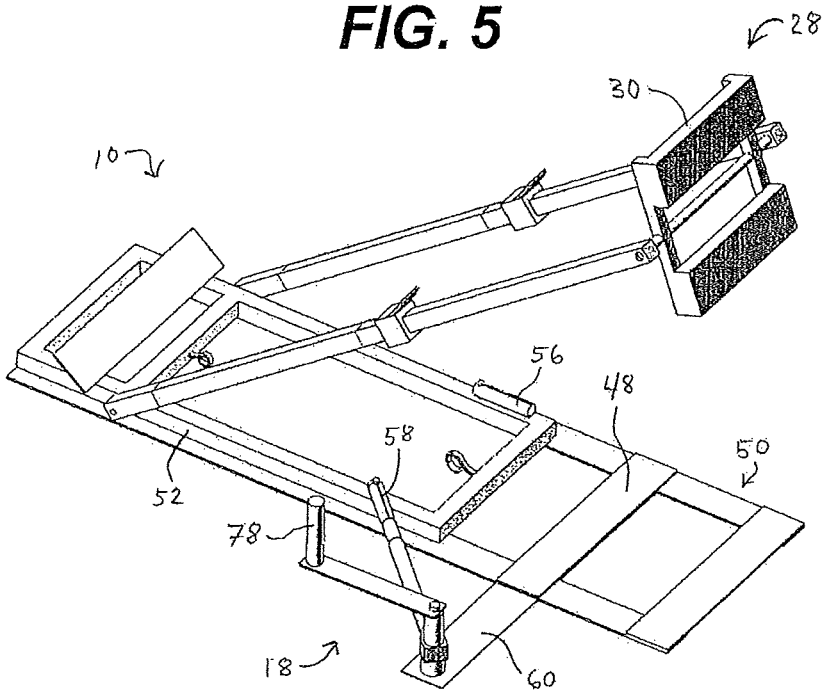
FIG. 6 is a perspective view of an alternate embodiment of an orthopedic stretcher in accordance with the present invention.

The first support arm 20 includes a first sleeve 22 and a first rod 24 slidably extending from the first sleeve 22. The first rod 24 can be secured in an extended or retracted position relative to the first sleeve 22 by a first rod clamp 26. The first rod 24 and the first sleeve 22 can have various cross sectional profiles in accordance with the present invention, including, for example, circular, elliptical, square or rectangular. A second rod 36 slidably extends from a second sleeve 34 to form a second support arm 68. Referring to FIG. 4, the length 64 of the first rod 24 extending beyond the first sleeve 22 can be selectively adjusted using the first rod clamp 26. Similarly, the length 66 of the second rod 36 extending from the second sleeve 34 can be adjusted using the second rod clamp 38, shown in FIG. 3. The extendable, or telescoping, nature of the first and second arms 20, 68 allows the stretcher 10 to accommodate different sized users.

Figure 21:
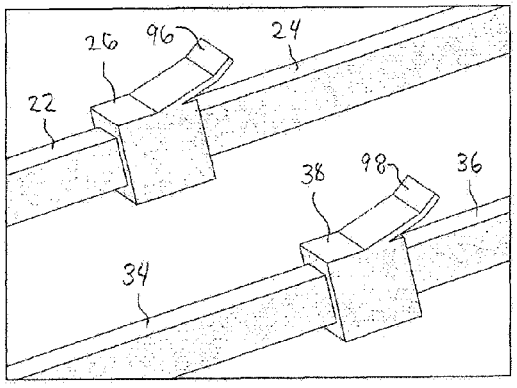
FIG. 21 is a detail perspective view of an orthopedic stretcher in accordance with the present invention.

First and second rod clamps 26, 38 in accordance with the present invention are shown generally in FIG. 21. The first rod clamp 26 includes a first tab 96 biased away from the first rod 24. Movement of the first tab 96 relative to the first rod clamp 26 operatively secures or releases the first rod 24. Similarly, the second rod clamp 38 includes a second tab 98. Movement of the second tab 98 relative to the second rod clamp 38 operatively secures or releases the second rod 36. In other embodiments in accordance with the present invention, the first and second rod clamps 26, 38 can include a rotating collar that can be twisted relative to the first and second sleeves 22, 34 to release or tighten a friction ring (not shown) around the first or second rods 24, 36. In other embodiments in accordance with the present invention, the first and second rod clamps 26, 38 can include various other types of rod clamps known in the art for releasably securing a rod in a sleeve.

Referring now to FIGS. 1-6, the first and second rods 24, 36 are each pivotally connected to a support 28. The support 28 may rotate relative to the first and second rods 24, 36. The support 28 includes a padded region 30 upon which a user's foot or leg may rest during stretching exercises, as seen in FIGS. 11-18. In one embodiment, the support 28 is mounted on a cross bar 32, shown in FIG. 2. The support 28 can be pivotally connected to the first and second rods 24, 36 using first and second support fasteners 40, 42, respectively, shown in FIGS. 1 and 2. In one embodiment, the first and second support fasteners 40, 42 each include a substantially cylindrical bolt inserted through clearance holes in the first and second rods, 24, 36, respectively and fastened at one end to the support 28. The support 28 may pivot to conform to the angle or shape of the user's foot or leg. The support 28 can include multiple padded regions 30.

The frame 52 is mounted on a base 50. The base 50 has a substantially flat shape for resting against a surface. In one embodiment, the base 50 includes a non-slip material, such as a rubber, for preventing the stretcher 10 from sliding when positioned on a floor or table.

Figure 11:
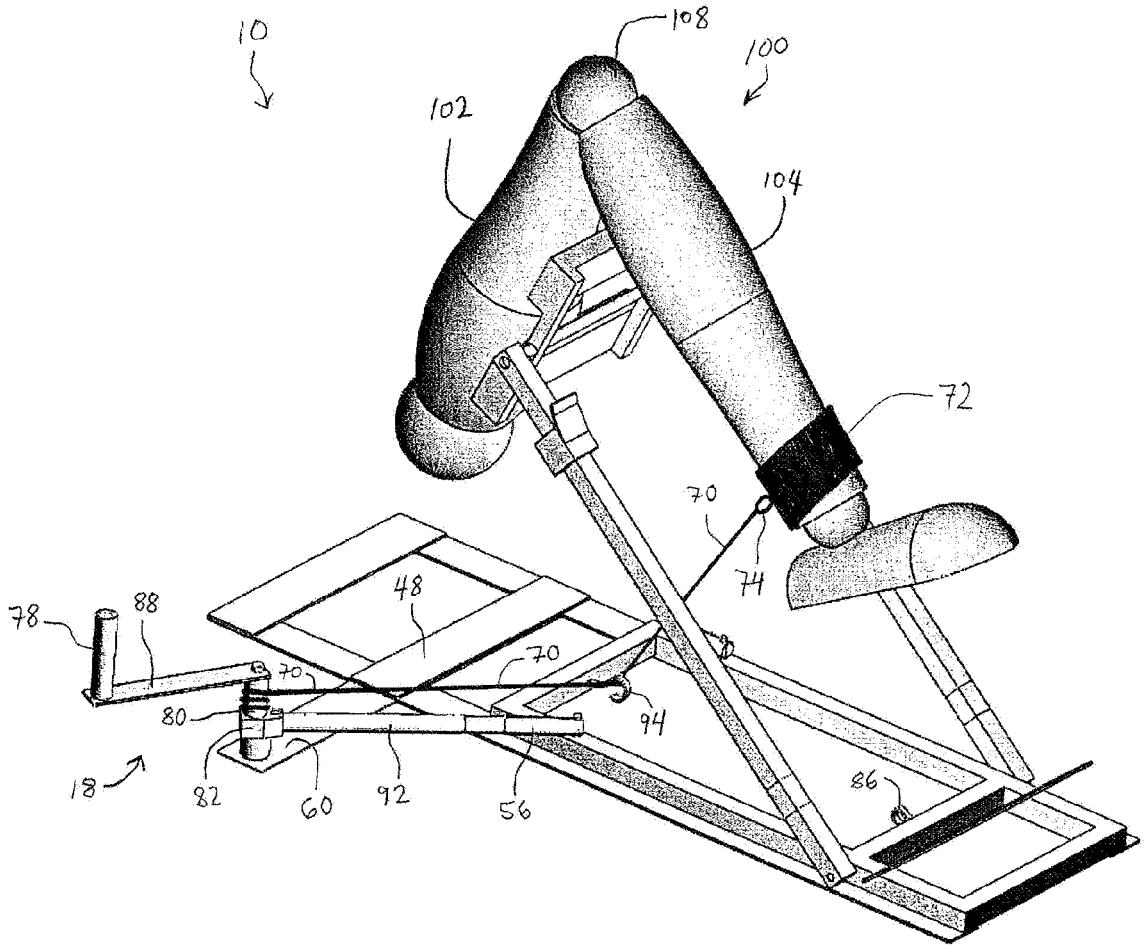
FIG. 11 is a perspective view of one embodiment of an orthopedic stretcher in accordance with the present invention.
Figure 12:
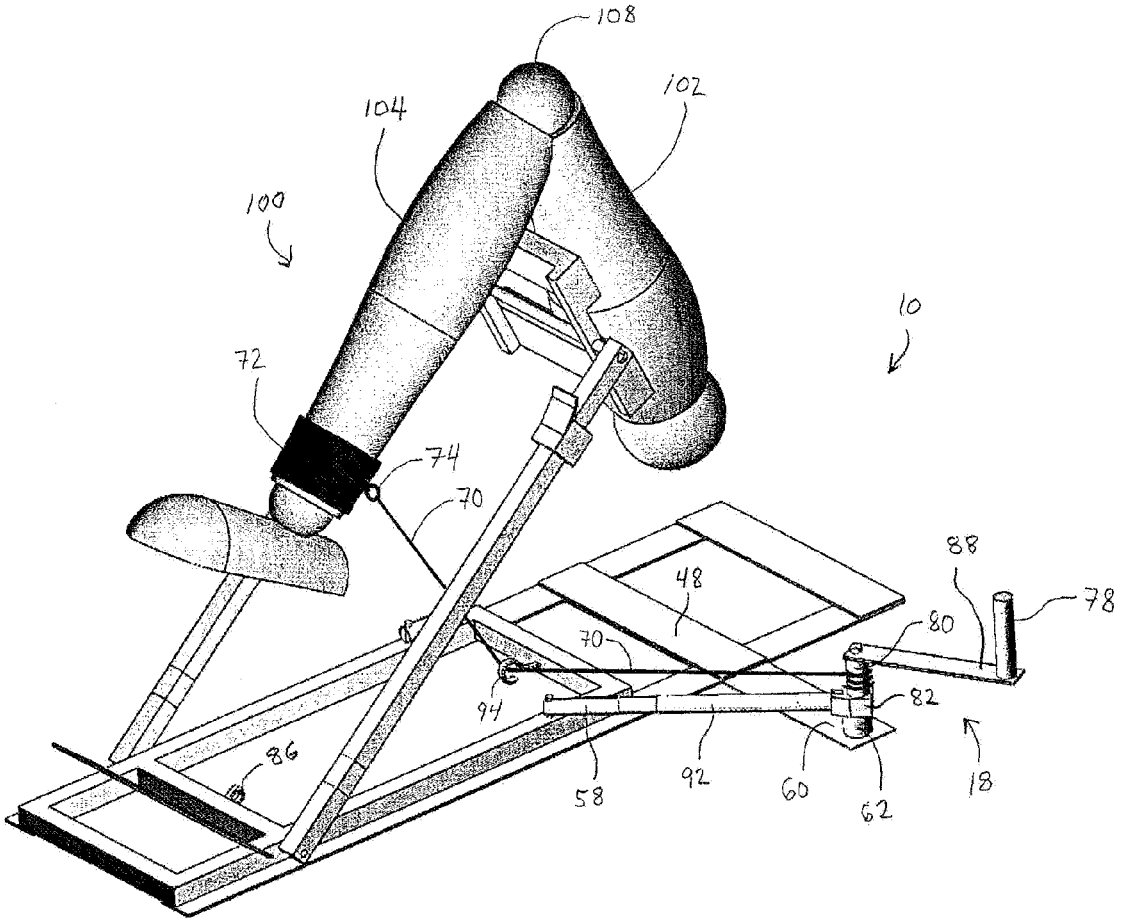
FIG. 12 is a perspective view of an alternate embodiment of an orthopedic stretcher in accordance with the present invention.
Figure 13:
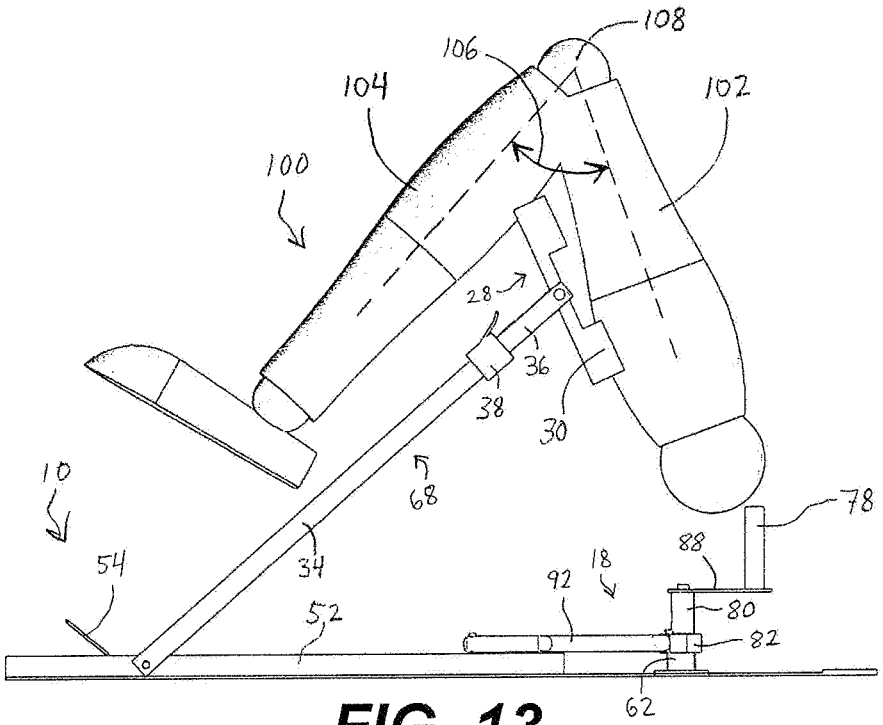
FIG. 13 is a left side elevation view of the orthopedic stretcher of FIG. 11.
Figure 14:
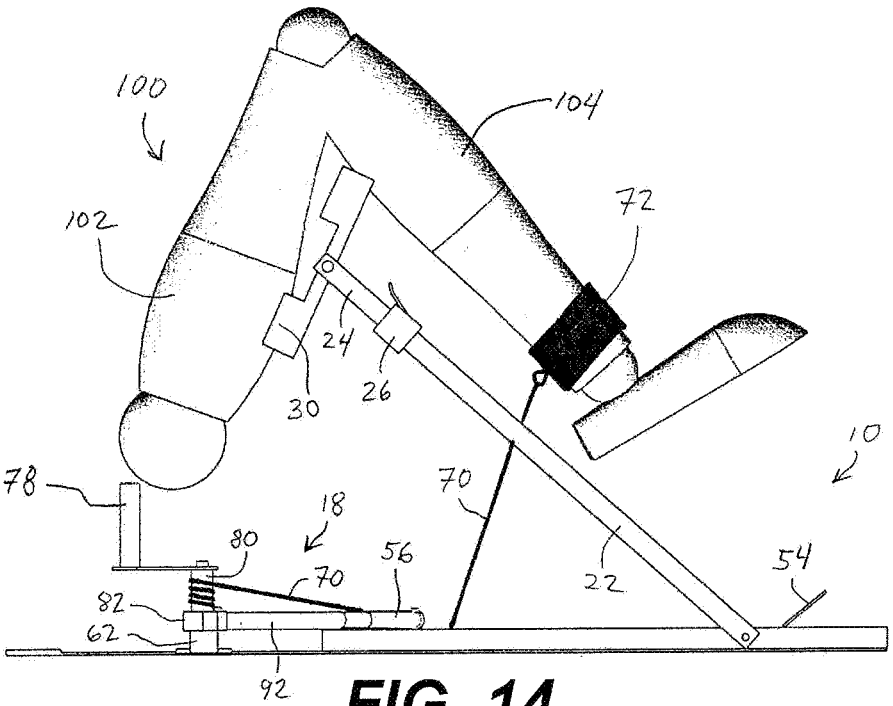
FIG. 14 is a right side elevation view of the orthopedic stretcher of FIG. 11.
Figure 15:
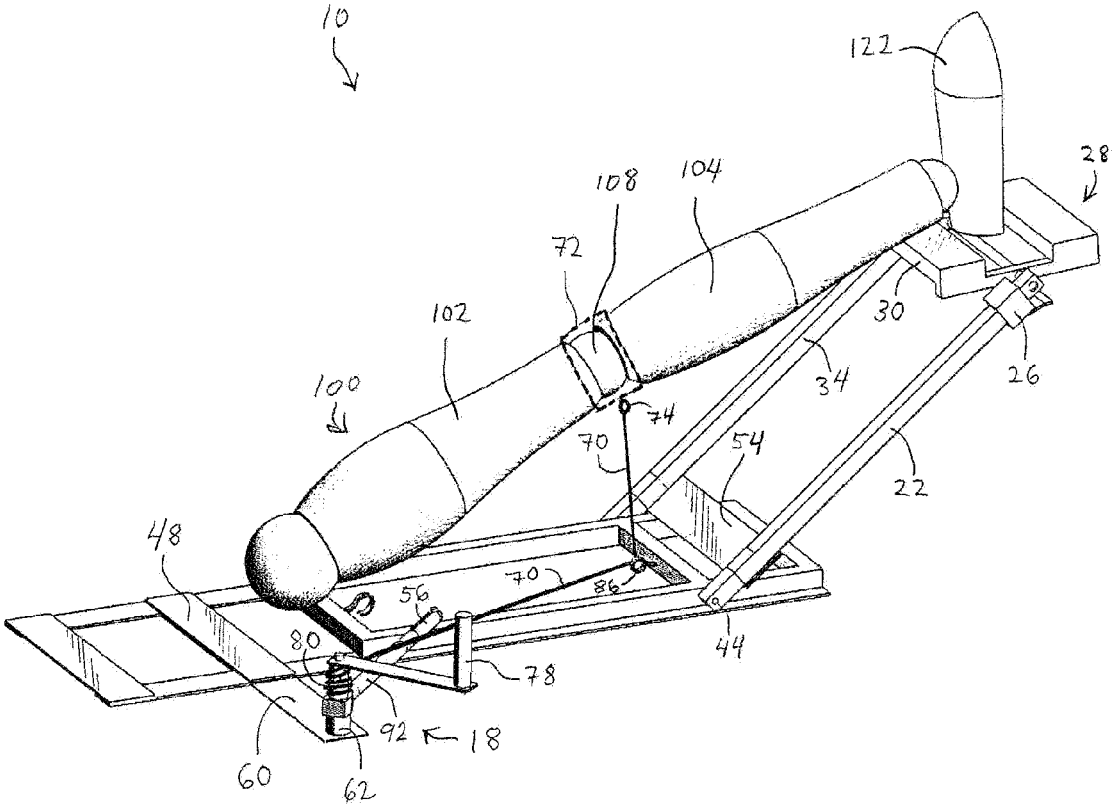
FIG. 15 is a perspective view of one embodiment of an orthopedic stretcher in accordance with the present invention.

The base 50 includes a base panel 48 extending laterally across the base 50, seen in FIGS. 1-8. In one embodiment, the base panel 48 detachably secures a spool assembly 18 to the base 50. The spool assembly 18 is detachably secured to the base 50 using a hook-and-loop fabric connection between the base panel 48 and the spool bracket 60. In this configuration, a hook-and-loop type fabric can be placed on both the spool bracket 60 and the base panel 48. In one embodiment, a detachable connection between the base panel 48 and spool bracket 60 allows the spool assembly 18 to be interchangeably mounted on either side of the stretcher 10. For example, a right-handed user may choose to mount the spool assembly 18 on the right side of the stretcher 10, as seen in FIG. 11. Similarly, a left-handed user may choose to mount the spool assembly 18 on the left side of the stretcher 10, as seen in FIG. 12. Ambidextrous spool assembly 18 mounting configurations seen in FIGS. 7, 8, 11, 12, 15, 16, 19 and 20 also allow users suffering bilateral knee injuries or operations to use one stretcher 10 for alternately stretching either leg.

Figure 19:
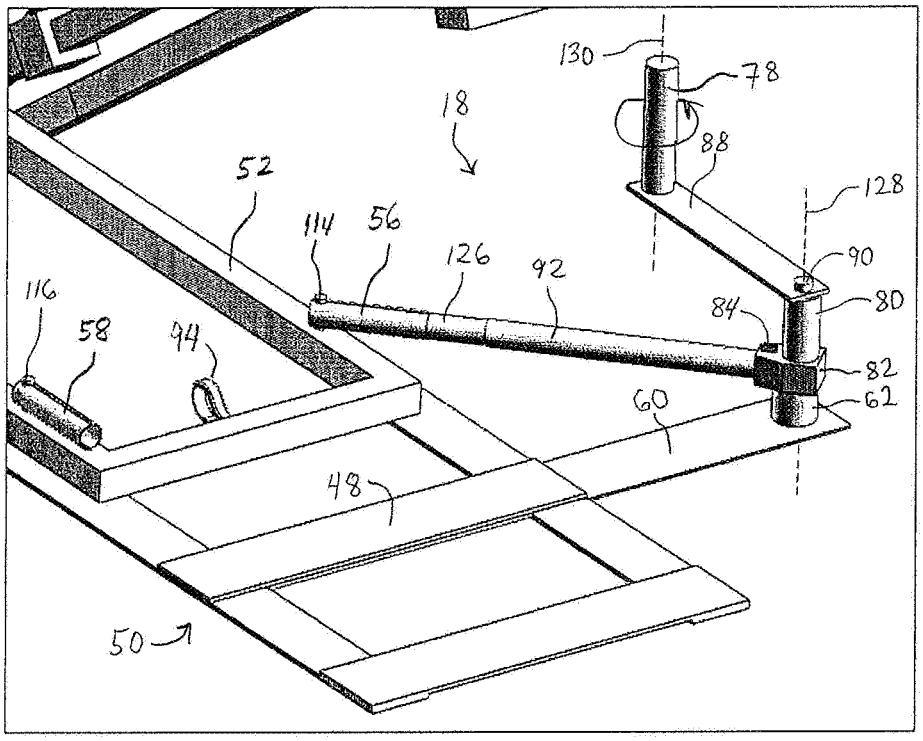
FIG. 19 is a detail perspective view of one embodiment of a spool assembly in accordance with the present invention.
Figure 20:
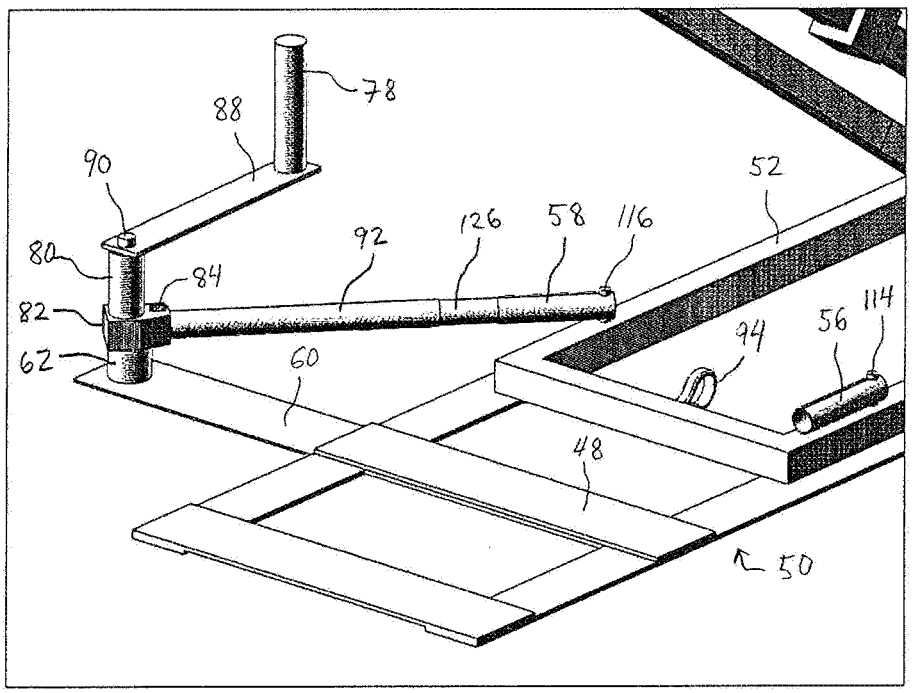
FIG. 20 is a detail perspective of an alternate embodiment of a spool assembly in accordance with the present invention.

Referring now to FIGS. 19 and 20, one embodiment of a spool assembly 18 in accordance with the present invention includes a spool 80 rotatably mounted on a ratchet 82. In one embodiment, the ratchet 82 includes a pawl and gear ratchet mechanism that allows the spool to rotate freely in one direction while preventing the spool from rotating in the opposite direction. The ratchet 82 includes a release switch 84 that allows the user or operator to engage or disengage the ratchet 82 for selectively rotating the spool in a clockwise or counter-clockwise direction. The release switch 84 can be engaged by the user or operator to release tension on the tension cable 70. In alternate embodiments, the spool 80 can be mounted on a friction disc or plurality of friction discs (not shown) for controlling angular displacement and angular velocity of the spool during force application and release. The release switch 84 in one embodiment can be positioned on the handle 78 so the user can release the ratchet 82 without taking the user's hand off the handle 78.

Referring to FIG. 19, the spool 80 generally rotates about a spool axis 128. A spool arm 88 connects the spool handle 78 to the spool 80. In one embodiment, a spool arm fastener 90 rigidly secures the spool arm 88 to the spool 80. A user or operator can control the rotation of the spool 80 by revolving the spool handle 78 about the spool axis 128. Revolving the spool handle 78 about the spool axis 128 causes the cable 70 (shown in FIG. 11) to be wound or unwound around the spool 80, depending on the direction of rotation of the spool 80.

In one embodiment, shown in FIGS. 19 and 20, the ratchet 82 is connected to the frame 52 by, inter alia, the ratchet arm 92. The ratchet arm 92 includes a distal end 126 extending away from the spool 80. The distal end 126 is inserted into a ratchet arm coupling 56 when the spool assembly 18 is mounted on the right side of the stretcher 10. In one embodiment, the ratchet arm coupling 56 is a cylinder having an opening at one end shaped for receiving the distal end 126 of the ratchet arm 92. The ratchet arm coupling 56 is pivotally connected to the frame 52 at one end using a coupling pin 114. The ratchet arm coupling 56 can rotate about the coupling pin 114. A second ratchet arm coupling 58 is pivotally connected to the frame 52, opposite the first ratchet arm coupling 56, using a second coupling pin 116, shown in FIGS. 19 and 20. The first and second ratchet arm couplings 56, 58 allow the spool assembly 18 to be mounted on either side of the base 50. Each ratchet arm coupling 56, 58 may be rotated flush with the frame 52 when not in use, as seen in FIGS. 19 and 20.

Figure 7:
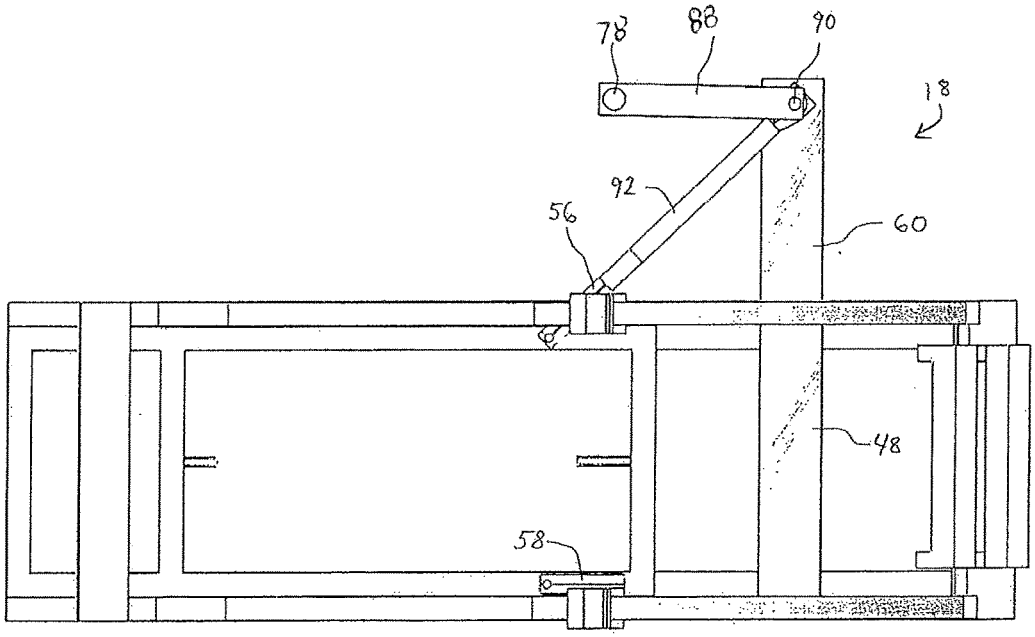
FIG. 7 is a plan view of the orthopedic stretcher of FIG. 5.
Figure 8:
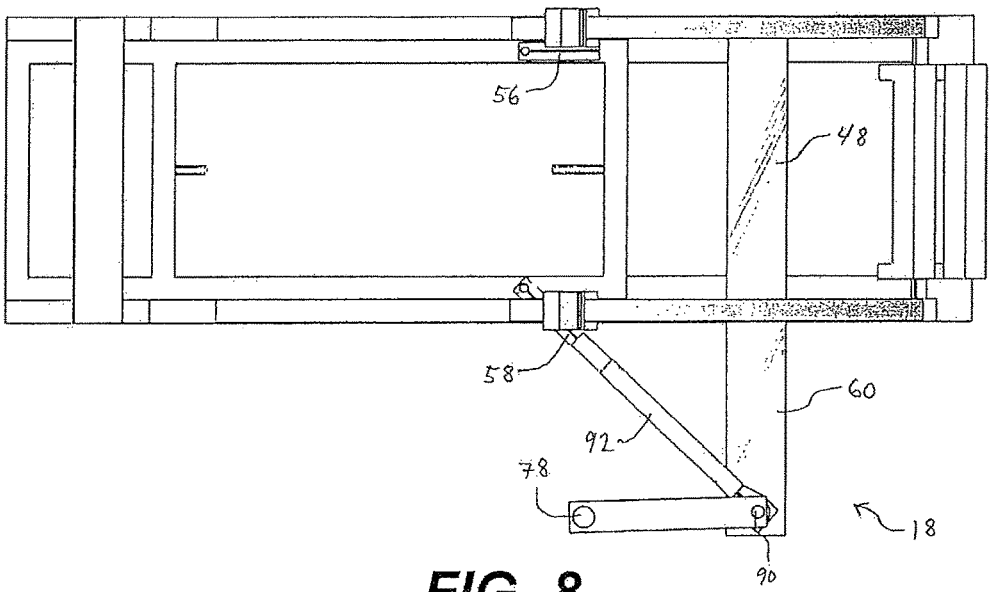
FIG. 8 is a plan view of the orthopedic stretcher of FIG. 6.

The ratchet 82 is pivotally connected to the spool bracket 60 by a spool support 62. The ratchet 82 and ratchet arm 92 can rotate on the spool support 62 relative to the spool bracket 60 for allowing the spool assembly 18 to be mounted on either side of the base 50, as seen in FIGS. 7 and 8. Additionally, in one embodiment, the spool handle 78 is pivotally mounted on the spool arm 88 so that the spool handle 78 can rotate about a handle axis 130. In another embodiment, the bracket 60 and the spool support 62 are integrally formed as one piece.

Figure 9:
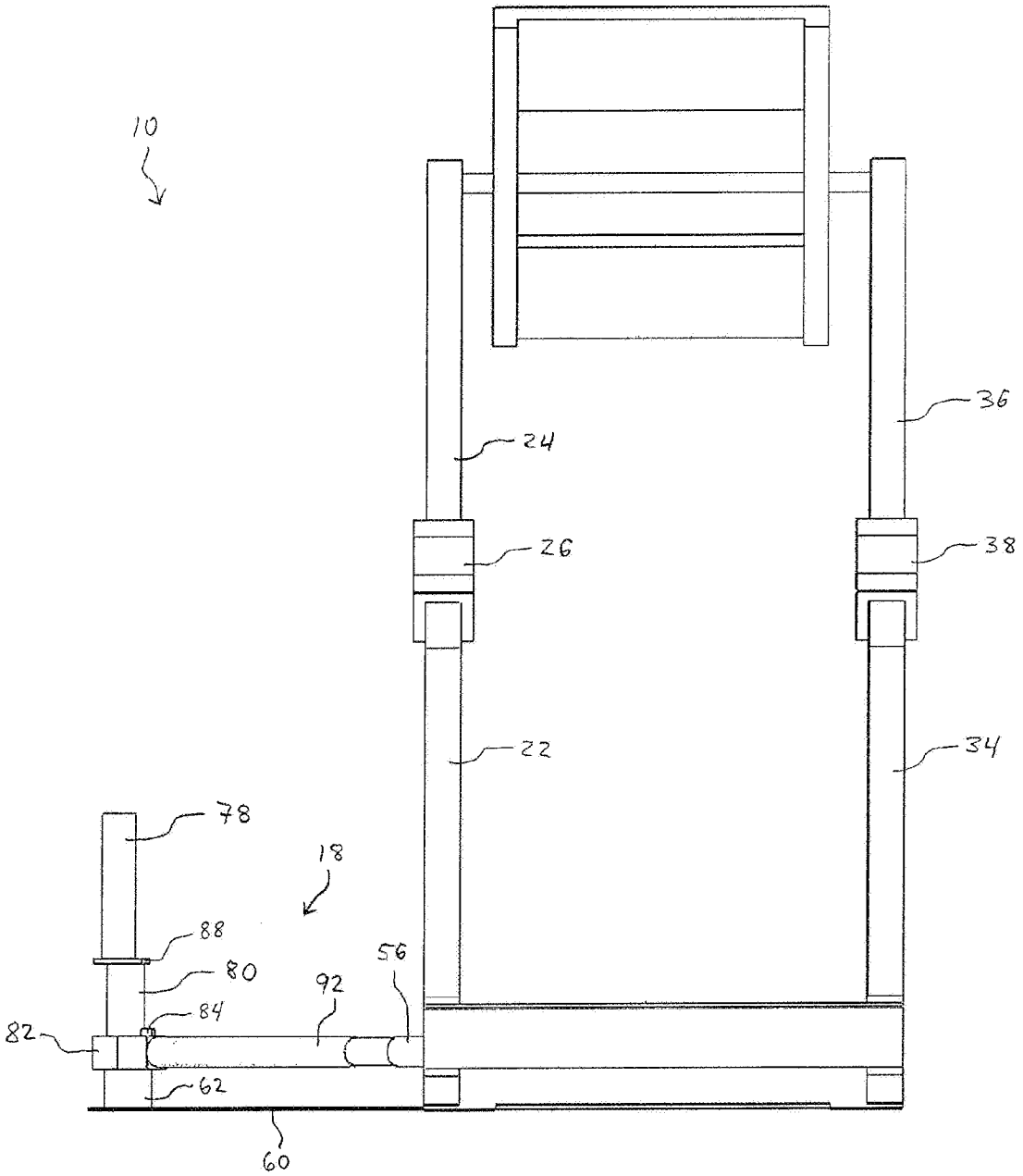
FIG. 9 is a front elevation view of the orthopedic stretcher of FIG. 1.
Figure 10:
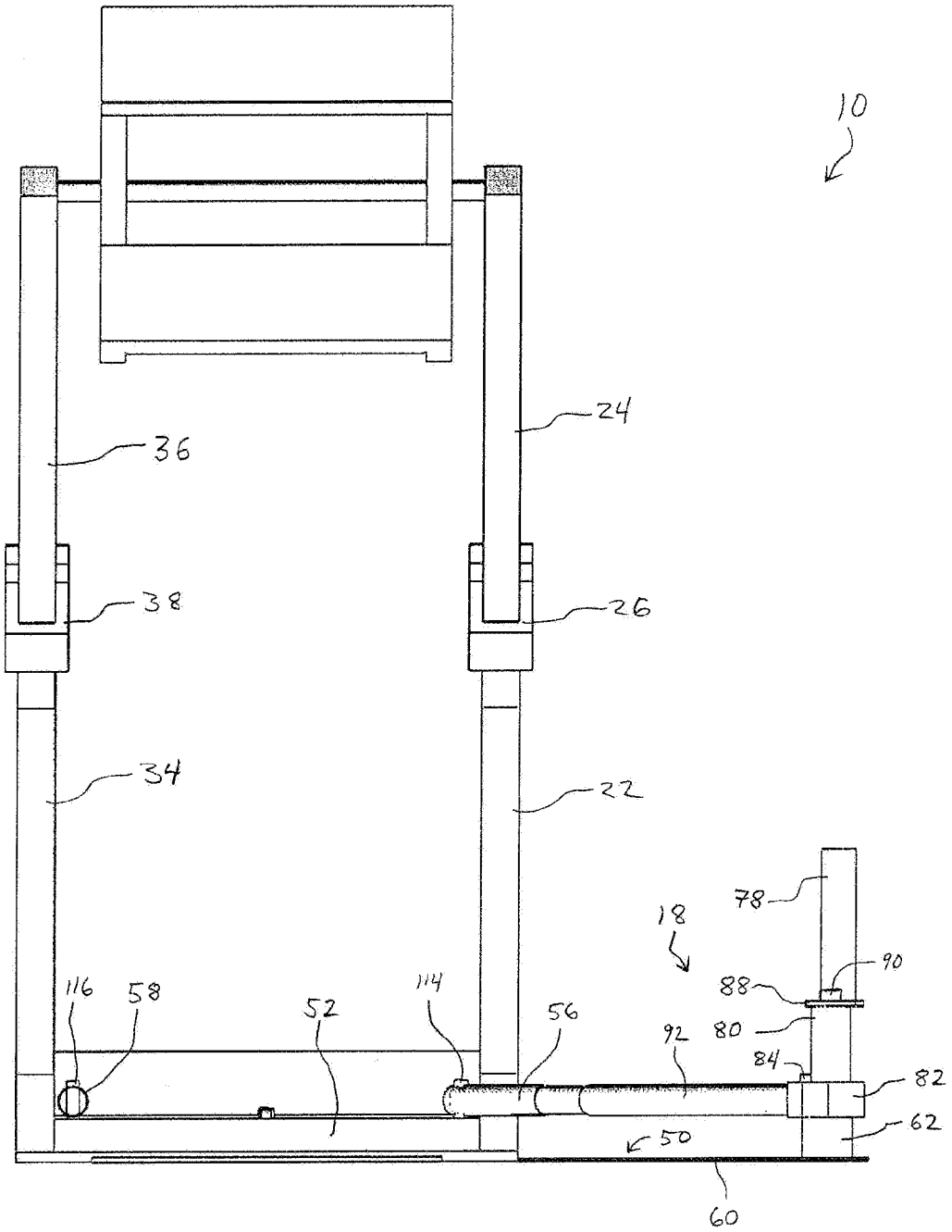
FIG. 10 is a back elevation view of the orthopedic stretcher of FIG. 1.

Referring now to FIG. 9, a front view of a stretcher 10 in accordance with the present invention is shown. Referring to FIG. 10, a back view of the stretcher 10 shown in FIG. 9 is shown. The stretcher 10 of FIGS. 9 and 10 includes a spool assembly 18 positioned on the right-hand side of the stretcher as seen by the user.

Referring now to FIGS. 11-14, a stretcher 10 positioned under a user's leg 100 is generally shown. The user's leg 100 includes an upper portion 102 and a lower portion 104. The stretcher 10 shown in FIGS. 11-14 is generally configured for flexion exercises. The support 28 is positioned under the user's knee 108, seen in FIG. 13. The pad 30 may engage the upper leg 102, the lower leg 104, the back of the knee 108 or a combination thereof. Referring again to FIG. 11, a strap 72 is detachably secured around the lower leg 104. In one embodiment, the strap 72 is made of fabric and includes a hook-and-loop fabric closure for detachably securing the strap 72 to the leg 100. The strap 72 can include a strap fastener 74 for engaging the tension cable 70. In one embodiment, the tension cable 70 can be detached from and reattached to the strap 72 using the strap fastener 74, allowing the user to detach the leg 100 from the stretcher 10 without removing the strap 72 from the leg 100.

A tension cable 70 extends from the strap fastener 74 to the spool 80. In one embodiment, shown in FIGS. 11 and 12, the tension cable 70 passes through a first tension cable guide 94 connected to the frame 52. In other embodiments not shown, the tension cable 70 may extend directly from the spool 80 to the strap 72. Also, the cable 70 may pass through additional cable guides.

A user can manually adjust the tension in the tension cable 70 by rotating the spool 80 using the handle 78. As the spool is rotated, the ratchet 82 prevents the spool 80 from reversing angular directions. The tension in the tension cable 70 can be incrementally adjusted by the user to control the angle 106 between the upper leg 102 and the lower leg 104, shown in FIG. 13. Upon reaching a desired angle 106, the user can release the handle 78 and the ratchet 82 prevents the spool from reversing. The spool assembly 18 will then maintain constant tension on the tension cable 70, holding the leg in a static position. The user or operator can disengage the ratchet 82 to release the tension in the tension cable 70 using the release switch 84, and by rotating the spool in the opposite direction. In an alternate embodiment, the ratchet 82 includes a friction disc or a plurality of friction discs (not shown) that prevent the spool from spinning freely upon disengagement of the ratchet 82. The friction disc(s) are adjusted to limit the angular velocity and angular acceleration of the spool as it unwinds, thereby precisely controlling the tension release rate.

Referring now to FIGS. 15-18, the stretcher 10 is generally shown in a configuration adapted for extension exercise. In this configuration, the first and second sleeves 22, 34 are rotated relative to the frame 52 about the first and second hinges 44, 46. In one embodiment the first and second hinges 44, 46 each include a cylindrical bolt inserted through the frame and through the first and second sleeves 22, 34, respectively.

Figure 22:
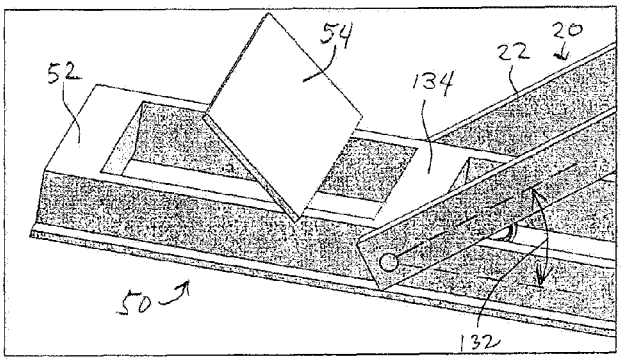
FIG. 22 is a detail perspective view of an orthopedic stretcher in accordance with the present invention.
Figure 23:
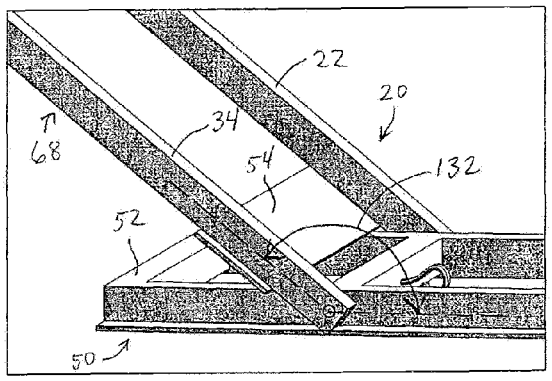
FIG. 23 is a detail perspective view of an orthopedic stretcher in accordance with the present invention.

Referring now to FIGS. 22 and 23, the first and second support arms 20, 68 can pivot relative to the frame 52. In a first position where the support angle 132 is less than ninety degrees, seen in FIG. 22, the first and second support arms 20, 68 are generally oriented for flexion exercises. In a second position where the support angle 132 is greater than ninety degrees, seen generally in FIG. 23, the first and second support arms 20, 68 are generally oriented for extension exercises. It is possible using the present invention, however, that a support angle 132 less than ninety degrees could be used for extension exercises, or that a support angle 132 greater than ninety degrees could be used for flexion exercises.

The maximum support angle 132 is limited by a pivot plate 54 rigidly connected to the frame 52. The pivot plate 52 contacts the first and second sleeves 22, 34 of the first and second support arms 20, 68 to prevent further increase in the support angle 132. The first and second sleeves 22, 32 may be oriented at angles such that they do not contact the pivot plate 54 for flexion or extension exercise, but the pivot plate defines the maximum achievable support angle 132.

Referring again to FIGS. 15-18, the padded region 30 of the support 28 in this configuration can engage the foot 122, the lower leg 104 or both. In this configuration, the user can position the strap 72 on the knee 108, the lower leg 104 or the upper leg 102. The tension cable 70 can be detachably secured to the strap 72 using the strap fastener 74. In another embodiment, the strap 72 can be directly attached to the tension cable 70. In one embodiment, the tension cable 70 extends through a second cable guide 86 between the spool 80 and strap 72. The positioning of the second cable guide 86 influences, inter alia, the direction of the force vector that is applied to the leg 100 when the cable 70 is tightened.

Figure 16:
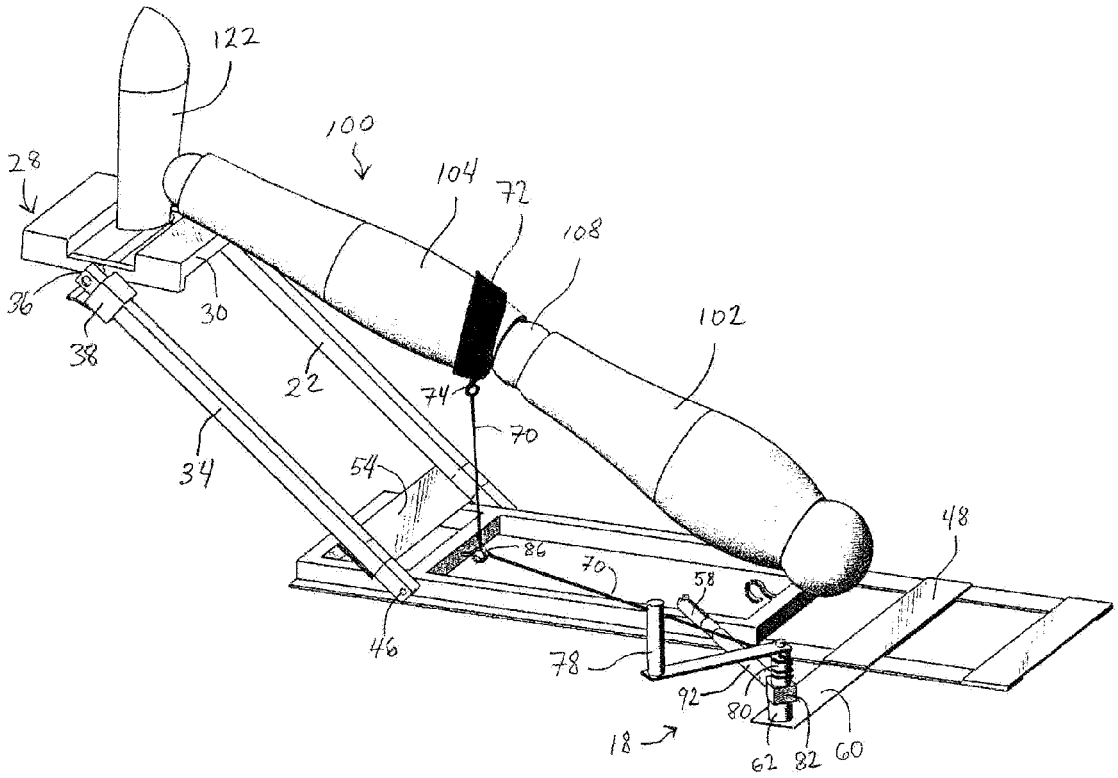
FIG. 16 is a perspective view of an alternate embodiment of an orthopedic stretcher in accordance with the present invention.
Figure 17:
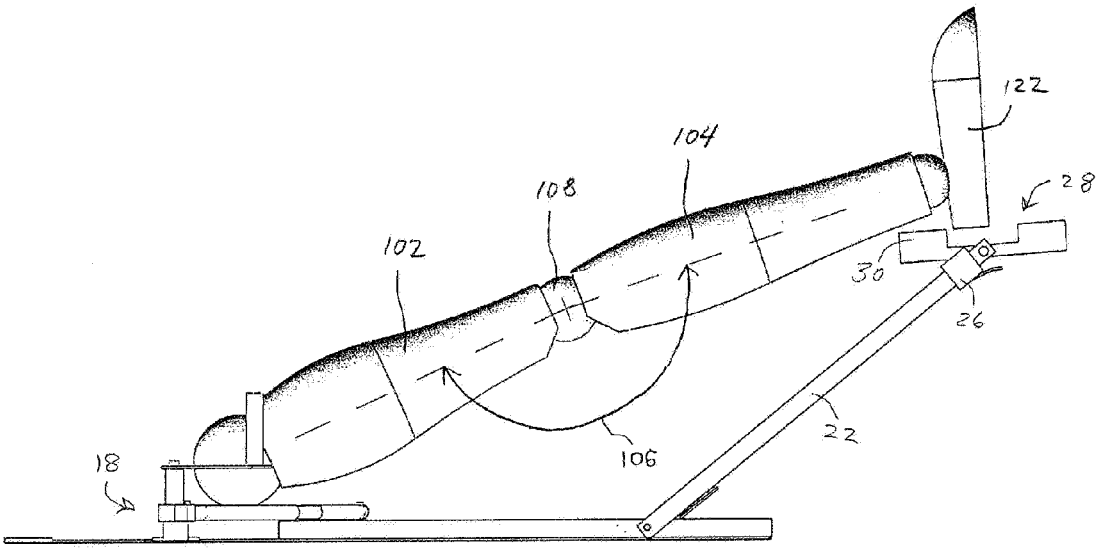
FIG. 17 is a right side elevation view of the orthopedic stretcher of FIG. 15.
Figure 18:
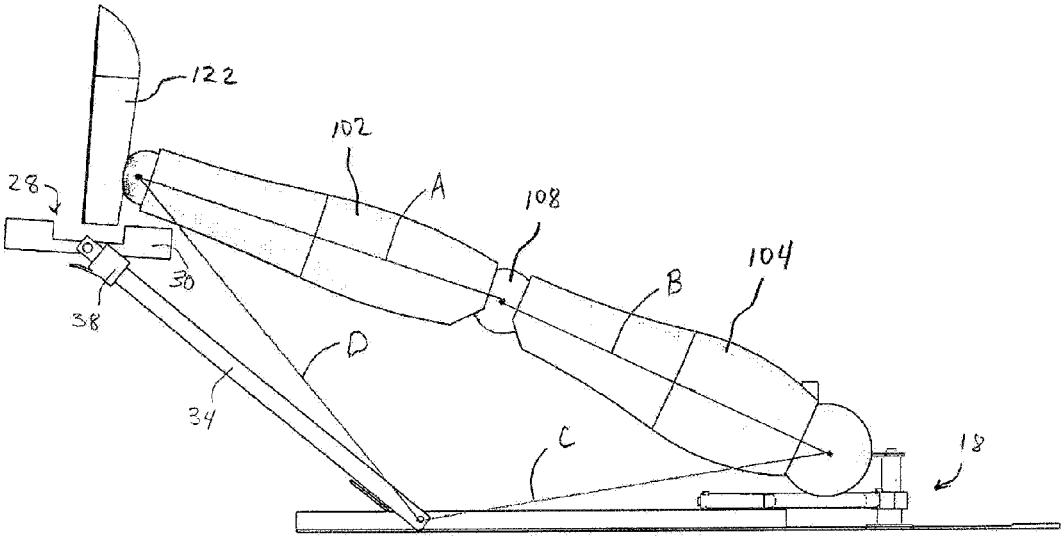
FIG. 18 is a left side elevation view of the orthopedic stretcher of FIG. 15.

Referring to FIG. 16, the user or operator can rotate the spool 80 by revolving the handle 78 about the spool 80. The ratchet 82 prevents the spool 80 from reversing direction. As tension is applied to the cable 70, the angle 106 between the upper leg 102 and the lower leg 104 increases. In this configuration, the leg 100 and stretcher 10 form a kinematic four bar linkage substantially having members A, B, C and D, shown in FIG. 18. Referring to FIG. 17, once a desired angle 106 is attained, the user can release the handle 78 and the ratchet 82 will prevent the spool from releasing tension. At this point, the stretcher 10 will maintain a static angle 106 between the upper leg 102 and lower leg 104. The user can then disengage the ratchet 82 by activating the release switch 84 and then release the cable tension in a controlled manner by rotating the handle 78. In an alternate embodiment, not shown, the rate of tension release can be controlled by a friction disc or a plurality of friction discs positioned between the spool and ratchet.

Figure 24:
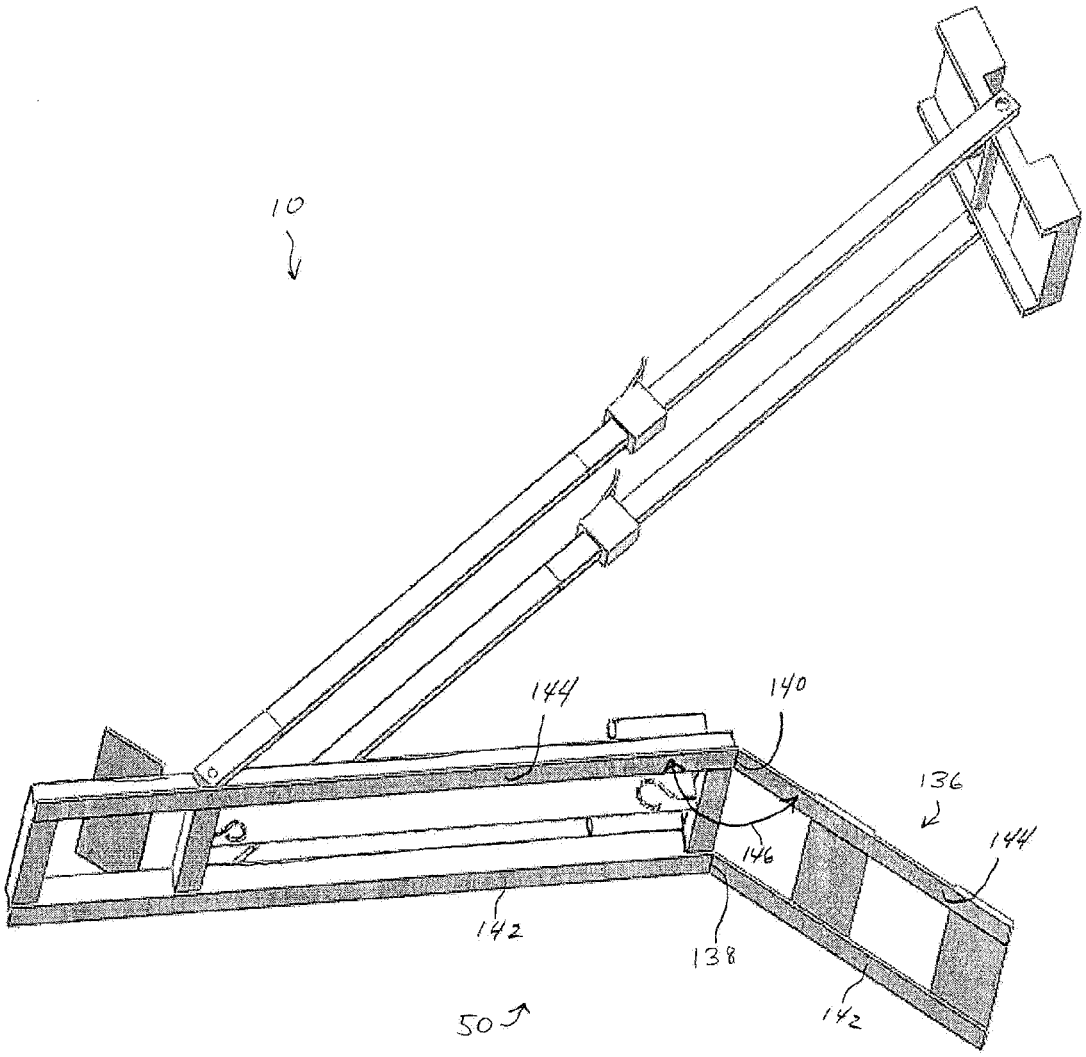
FIG. 24 is a perspective view of one embodiment of an orthopedic stretcher in accordance with the present invention.

Referring now to FIG. 24, another embodiment of an orthopedic stretcher 10 in accordance with the present invention includes a folding portion 136 pivotally attached to the base 50. The folding portion 136 generally folds at a fold angle 146 relative to the base. The fold angle 146 extends substantially between zero and 180 degrees. The folding portion 136 can fold flatly against the base 50 for ease of storage or transport. The folding portion 136 attaches to the base at first and second pivoting joints 138, 140. In one embodiment, the first and second pivoting joints 138, 140 are formed from first and second flexible longitudinal pads 142, 144 extending continuously across the base 50 and folding portion 136. In another embodiment, the first and second pivoting joints 138, 140 include mechanical hinges.

Figure 25:
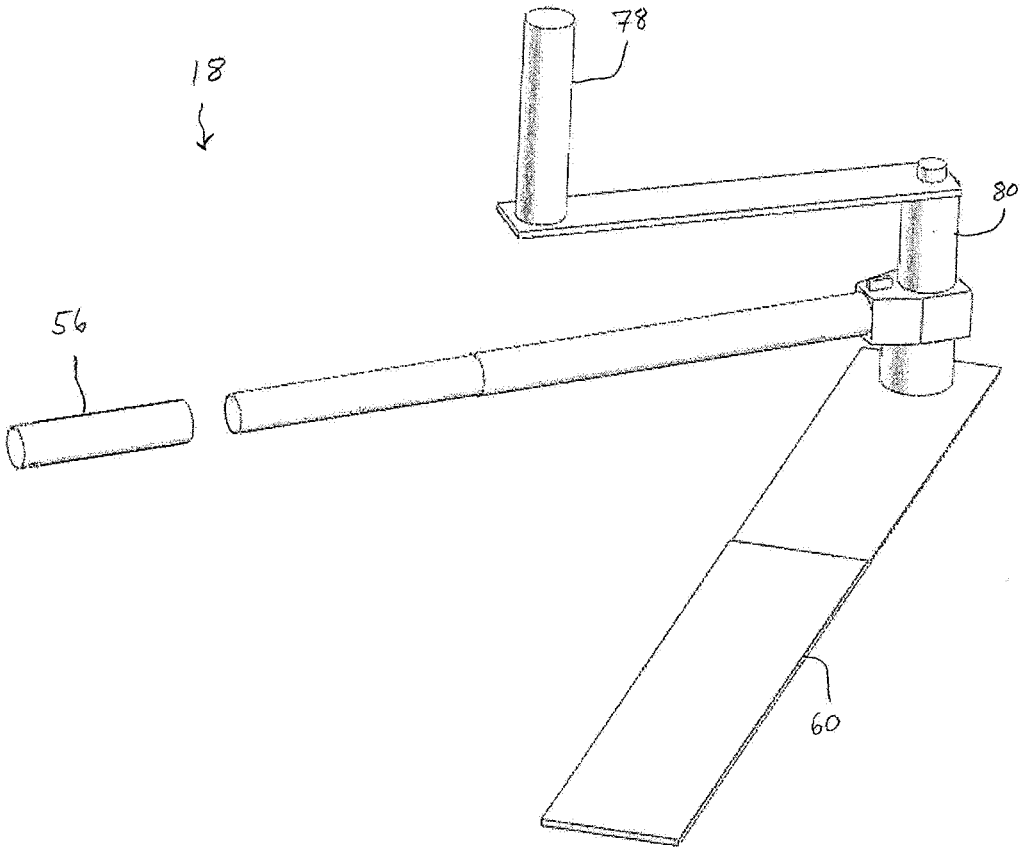
FIG. 25 is a perspective view of a detachable spool assembly in accordance with the present invention.

Referring now to FIG. 25, the present invention also includes a detachable spool assembly 18 having a locking, or ratcheting, spool 80 connected to a handle 78. The spool assembly 18 includes a bracket 60 and a coupling 56 that can each be connected to a stretching device at numerous locations.

In yet another embodiment, the stretcher 10 includes a device to measure the angle of flexion or extension of the support arm 20 relative to the base 50. In one embodiment, the angle is measured by a goniometer attached to the stretcher at the first or second support hinge 44, 46, shown in FIGS. 1 and 2. In one embodiment, the goniometer is detachable. In yet another embodiment, the goniometer is integrally formed on the stretcher 10. In another embodiment, the stretcher 10 also includes a force transducer to determine the force applied to the leg by the cable.

Referring to FIGS. 26-35, another exemplary embodiment of an orthopedic stretcher 199 in accordance with the present invention is shown. The orthopedic stretcher 199 includes a base 200, a system of support rods 210, an upper leg support 220 for supporting a patient's upper leg, a lower leg support 230 for supporting a patient's lower leg, a slide 240 to adjust the lower leg support 230, and a controller 250.

Figure 27:
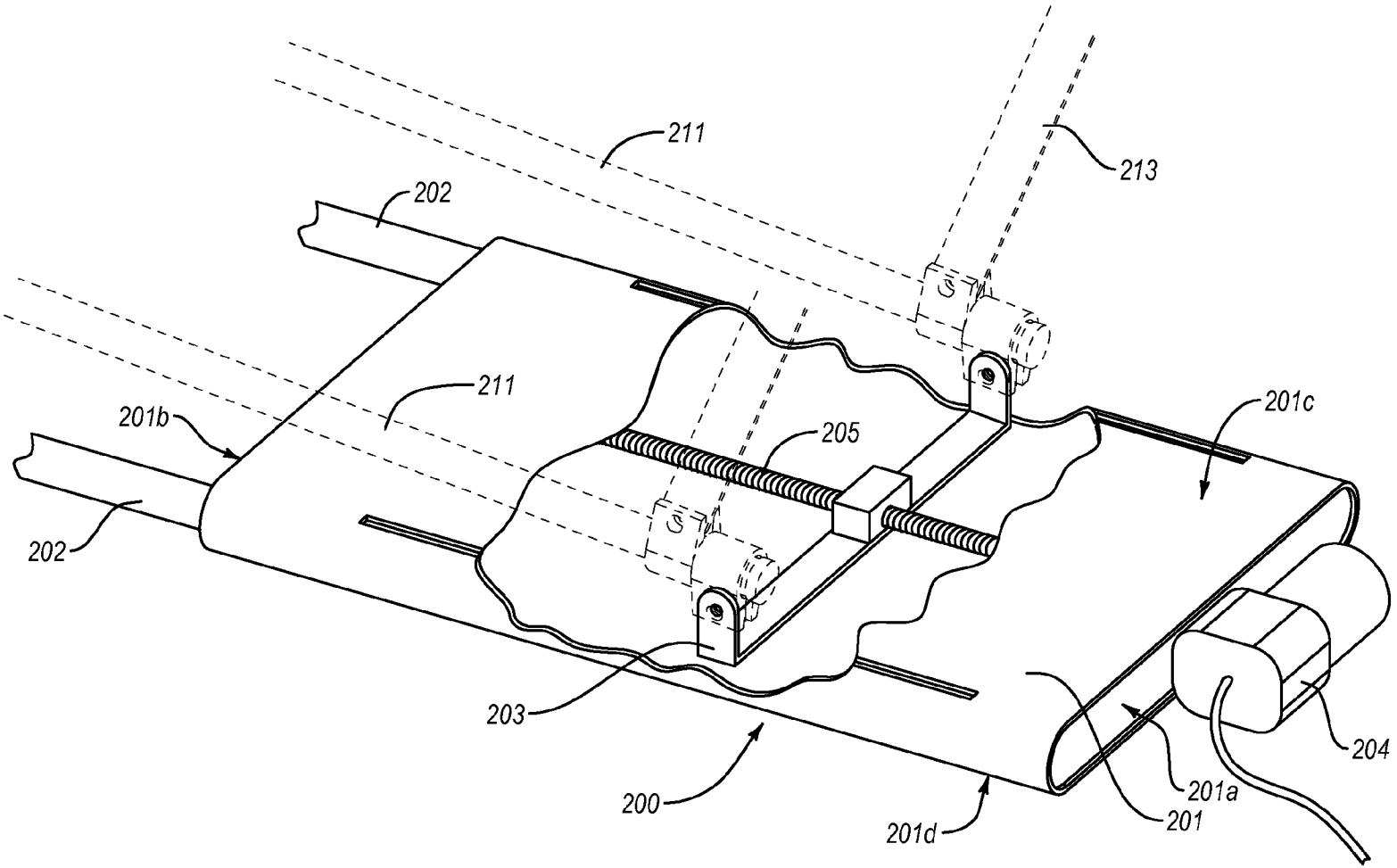
FIG. 27 is a partial cutaway view showing a lower drive mechanism of the orthopedic stretcher of FIG. 26.

As shown in FIG. 27, the base 200 may include a base body 201, extension rods 202, base bracket 203, and base motor 204 operationally connected to a base leadscrew 205. The base leadscrew 205 is rotationally connected to the base bracket 203 such that rotation of the base leadscrew 205 causes the base bracket 203 to move forward or backward along the length of the base body 201. In this embodiment, the base motor 204 and base leadscrew 205 are the means for moving the base bracket 203 in order to apply an extension force or a flexion force to the patient's leg. However, the means could take the form of many means known in the art, such as a rack-and-pinion, belt or roller chain and sprocket drive or equivalents. Similarly, the means for moving the base bracket 203 need not be exclusively mechanical, but could include electromagnetic, fluid pressure, or similar sources of motive force known in the art.

The base body 201 has a generally flat shape for resting on a support surface and has a proximal end 201*a* and distal end 201*b*, as well as an upper surface 201*c* and lower surface 201*d*. The base bracket 203 can span all or a portion of the width of the base body 201 and may protrude above the upper surface 201*c* of the base body 201. The extension rods 202 can extend from the distal end 201*b* of the base body 201. In another embodiment, the extension rods 202 may be slidably extendable from the base body 201.

Figure 26:
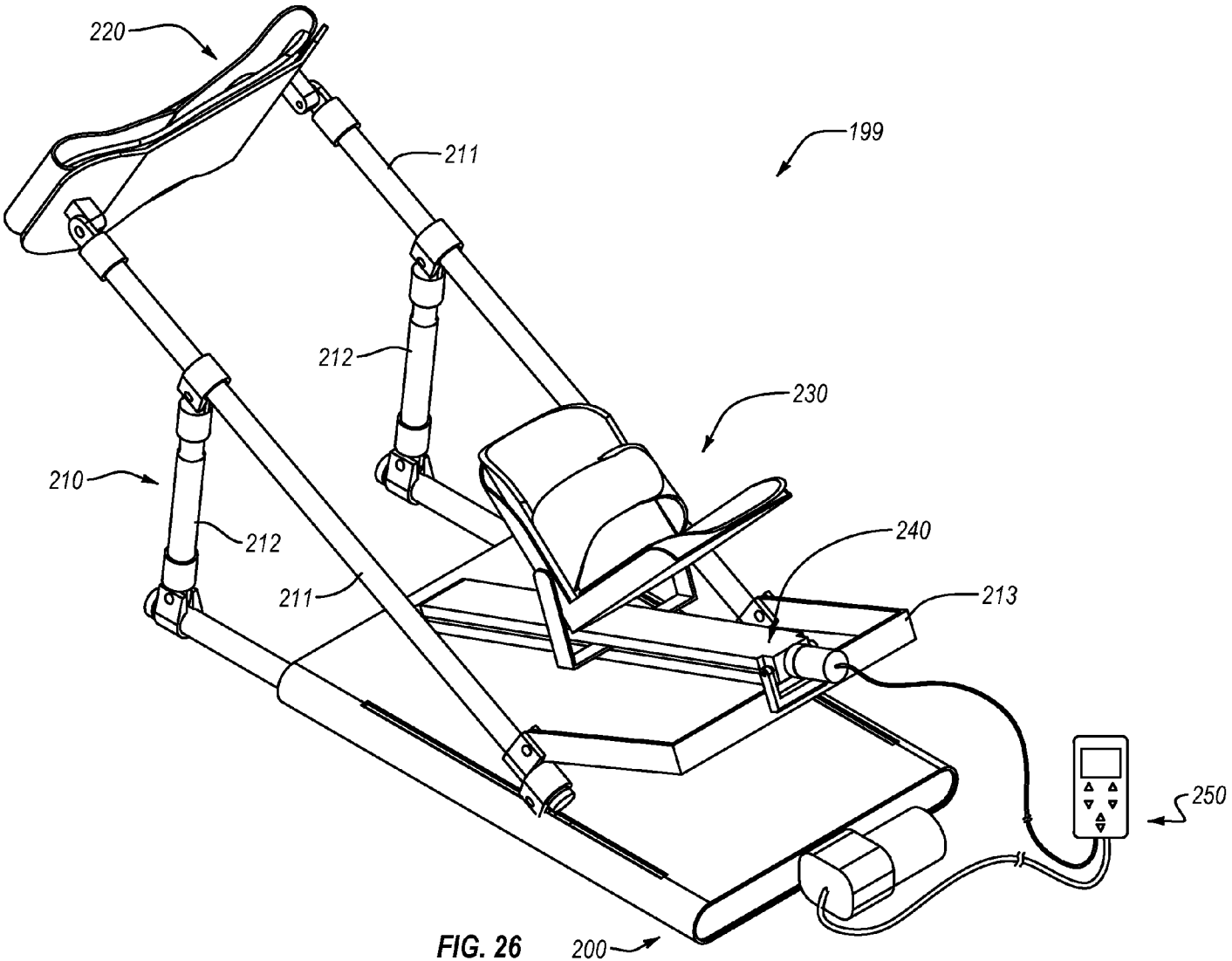
FIG. 26 is a perspective view of an orthopedic stretcher in accordance with another exemplary embodiment of the present invention.
Figure 28:
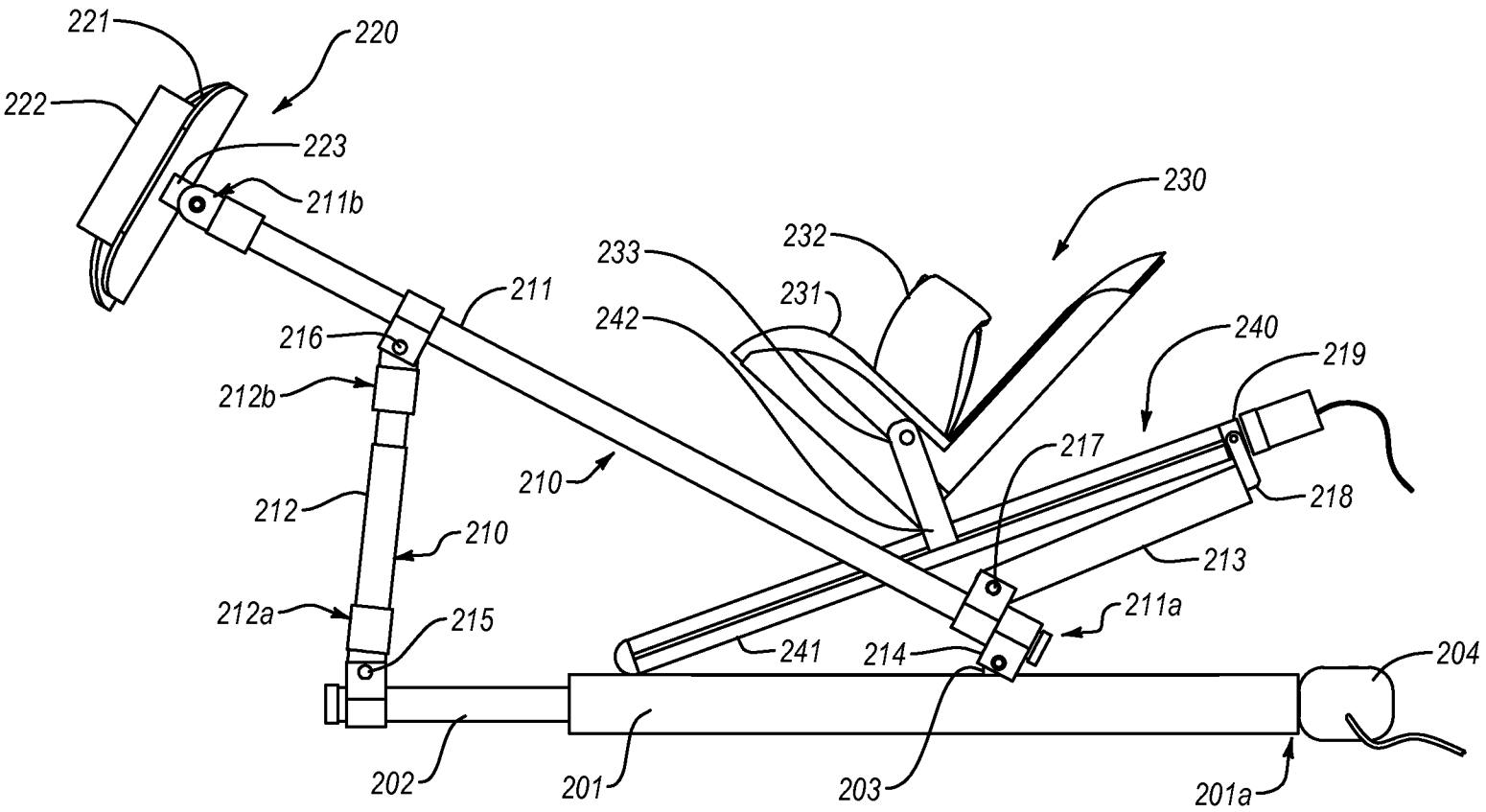
FIG. 28 is a side view of the orthopedic stretcher of FIG. 26.

Referring now to FIGS. 26 and 28, the system of support rods 210 may include front support rods 211, rear support rods 212, and a support bracket 213. The front support rods 211, having a proximal end 211*a* and a distal end 211*b*, can be pivotally attached, at the proximal end 211*a*, to the base bracket 203 at front support hinges 214. The rear support rods 212, having a proximal end 212*a* and a distal end 212*b*, can be pivotally connected, at their proximal end 212*a*, to the extension rods 202 at rear support hinges 215.

The front support rods 211 and rear support rods 212 can be, themselves, pivotally connected together at the top support hinge 216 at the distal end of the rear support rods 212*b* and an intermediate point along the front support rods 211, forming a triangular support structure with the front support hinge 214, rear support hinge 215, and the top support hinge 216 at the vertices of the triangle. The triangular support structure is thereby geometrically adjustable by driving the base bracket 203 forward and back, as discussed in greater detail below.

In some embodiment, the rear support rods 212 are selectively extendable and retractable, thereby adding another degree of adjustability to the triangular support structure formed by the front support hinge 214, rear support hinge 215, and the top support hinge 216 at the vertices of the triangle. For instance, when the upper leg support 220 is raised, lowered, or repositioned along the length of the base 200, rear support rods 212 may extend or retract to allow for adjustment of the triangle and the position of the upper leg support 220. To facilitate the selective extension and retraction of the rear support rods 212, the rear support rods 212 may comprise telescoping rods. In the current embodiment, the front support rods 211 and rear support rods 212 are round, but may have other cross-sections such as, but not limited to, square or elliptical.

Figure 29:
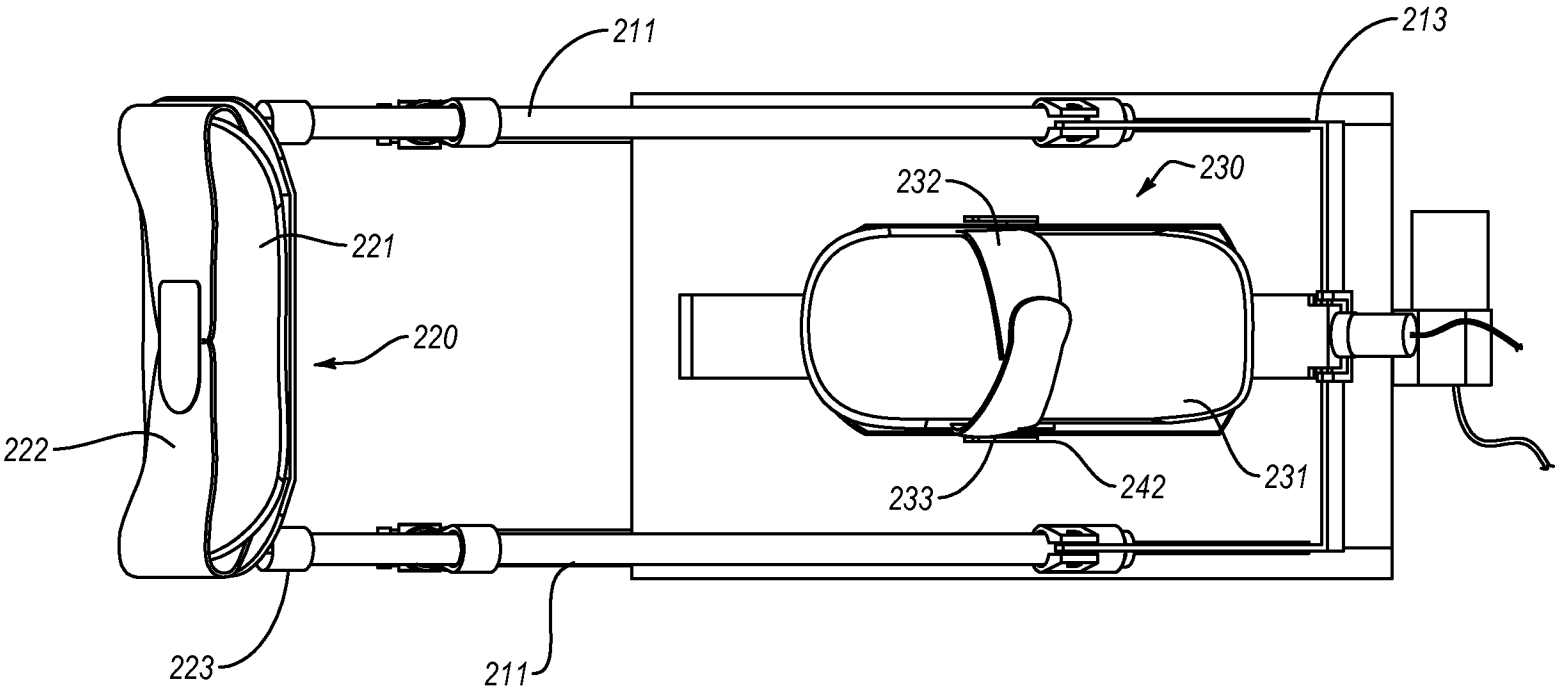
FIG. 29 is a top view of the orthopedic stretcher of FIG. 26.
Figure 30:
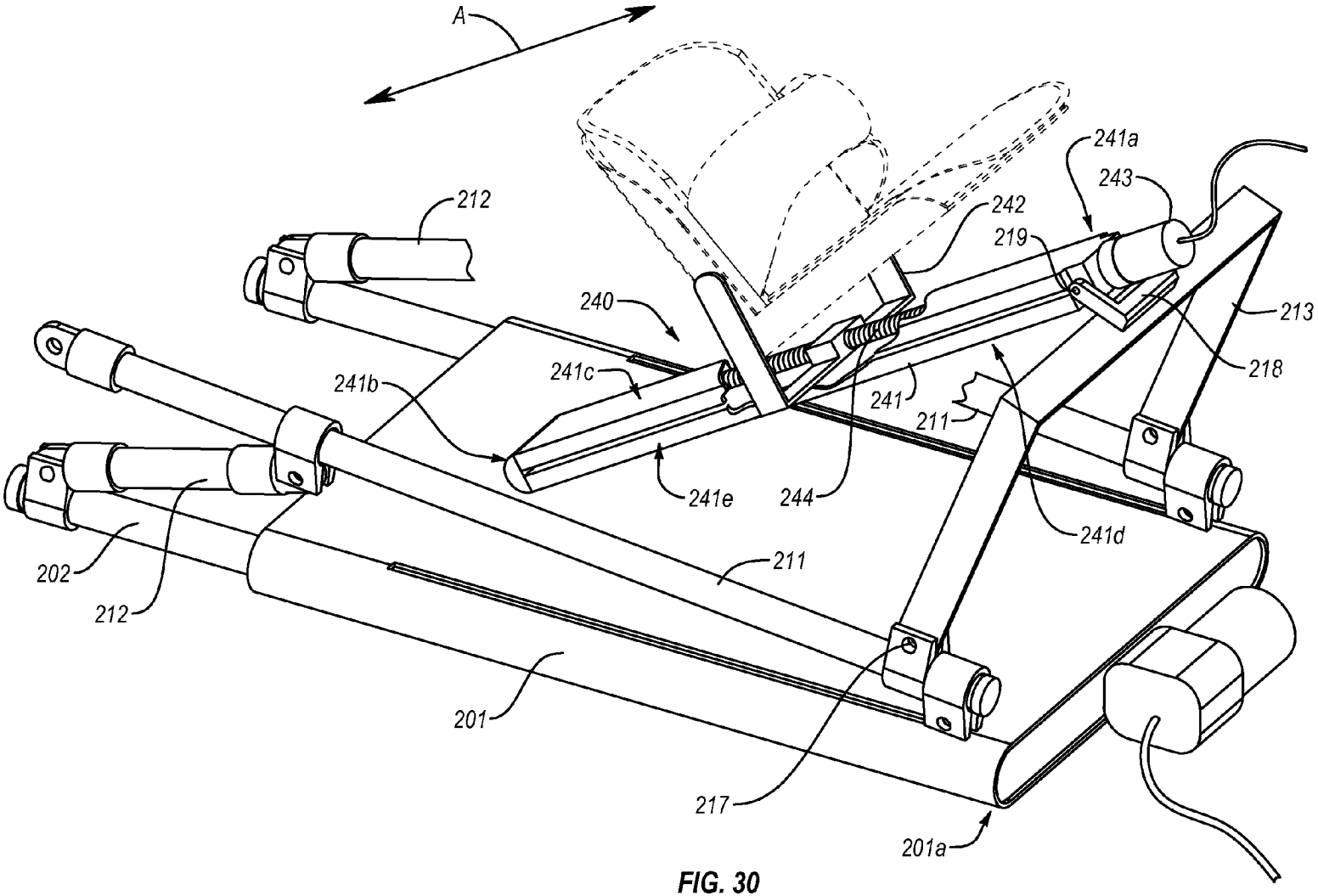
FIG. 30 is a partial cutaway view showing an upper drive mechanism of the orthopedic stretcher of FIG. 26.

Referring now to FIGS. 28, 29, and 30, the support bracket 213 can be pivotally connected at the lower support bracket hinges 217 near the proximal ends of the front support rods 211. In some embodiments, the rotational range of motion of the support bracket hinges 217 can be limited so as to prevent the support bracket 213 from fully rotating toward the proximal end 201*a* of the base body 201. This rotational limit can in turn limit the motion of the lower leg support 230 in the direction of the proximal end 201*a* of the base body 201. In some embodiments, as shown in the Figures, the support bracket 213 can have a support bracket extension 218 for connecting the support bracket 213 to the slide 240. Likewise, in some embodiments, support bracket hinges 217 may be movable along the length of front support rods 217. For instance, linear bearings may be disposed between the support bracket hinges 217 and the front support rods 217 to allow the lower end of the support bracket 213 to slide freely along the length of front support rods 217 while the device is running.

In one embodiment, the slide 240 includes a slide body 241, a slide bracket 242, and a slide motor 243 and slide leadscrew 244 to move the slide bracket 242 along the length of the slide body 241 in the directions indicated by double headed arrow A, as shown in FIG. 30. The slide body 241 is generally flat with a proximal end 241*a* and a distal end 241*b*, as well as top 241*c*, bottom 241*d*, and side surfaces 241*e*. The slide bracket 242 may be wider than the body 241 and protrude from the side surfaces 241*e*. The slide bracket 242 is rotationally connected to the slide leadscrew 244, such that, when the slide motor 243 turns the slide leadscrew 244, the slide bracket 242 moves along the length of the slide body 241. In this embodiment, the slide motor 243 and slide leadscrew 244 are the means for moving the slide bracket 242 and applying an extension force or a flexion force to the patient's leg. However, the means could take the form of many means known in the art, such as a rack-and-pinion, belt or roller chain and sprocket drive or equivalents. Similarly, the means for moving the slide bracket 242 need not be exclusively mechanical, but could include electromagnetic, fluid pressure, or similar sources of motive force known in the art. The proximal end 241*a* of the slide 240 is pivotally connected to the support bracket extension 218 at the upper support bracket hinge 219. Although not shown in the illustrated embodiment, the distal end 241*b* of the slide 240 may be connected to a central linear slide in the base body 201. The central linear slide may act as a track for the slide 240 to move back and forth along, as well as to prevent the slide 240 and/or lower leg support 230 from lifting during high degrees of flexion.

Figure 32:
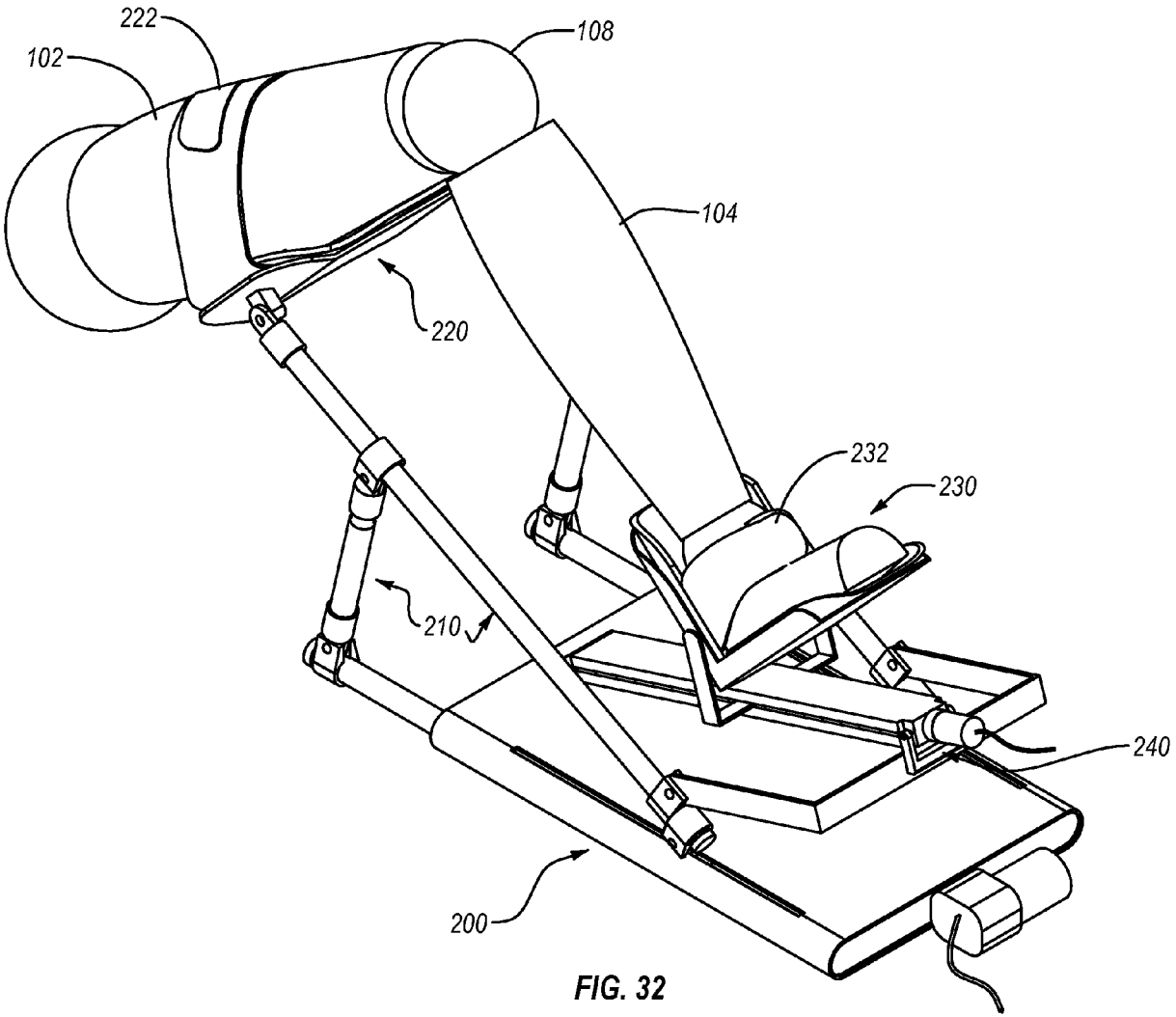
FIG. 32 is a perspective view of the orthopedic stretcher of FIG. 26 with a patient's leg secured therein.

As shown in FIG. 28-29, the upper leg support 220 may be pivotally connected to the distal ends 211*b* of the front support arms 211 at the upper leg support hinges 223 to allow rotation of the upper leg support 220 as the angle of the patient's upper leg changes during use. The upper leg support 220 can have a padded surface 221 to improve the patient's comfort. In addition, the upper leg support 220 can have a strap 222, or other means for restraint known in the art, for restraining the patient's upper leg 102, as depicted in FIG. 32. In some embodiments, the position of the upper leg support hinge 223 may be selectively repositionable along the front support arms 211 to accommodate patients with a range of morphologies.

Again referring to FIGS. 28, 29, and 32, the lower leg support 230 can be pivotally connected to the slide bracket 242 to allow rotation of the lower leg support 230 as the angle of the patient's lower leg 104 changes during use of the orthopedic stretcher 199. The lower leg support 230 can have a padded surface 231 to improve the patient's comfort. In addition, the lower leg support 230 can have a strap 232, or other means for restraint known in the art, for restraining the patient's lower leg 104, as depicted in FIG. 32. In a particular embodiment, the lower leg support 230 may comprise a boot-like support to restraint and secure the patient's ankle and foot during use.

Figure 31:
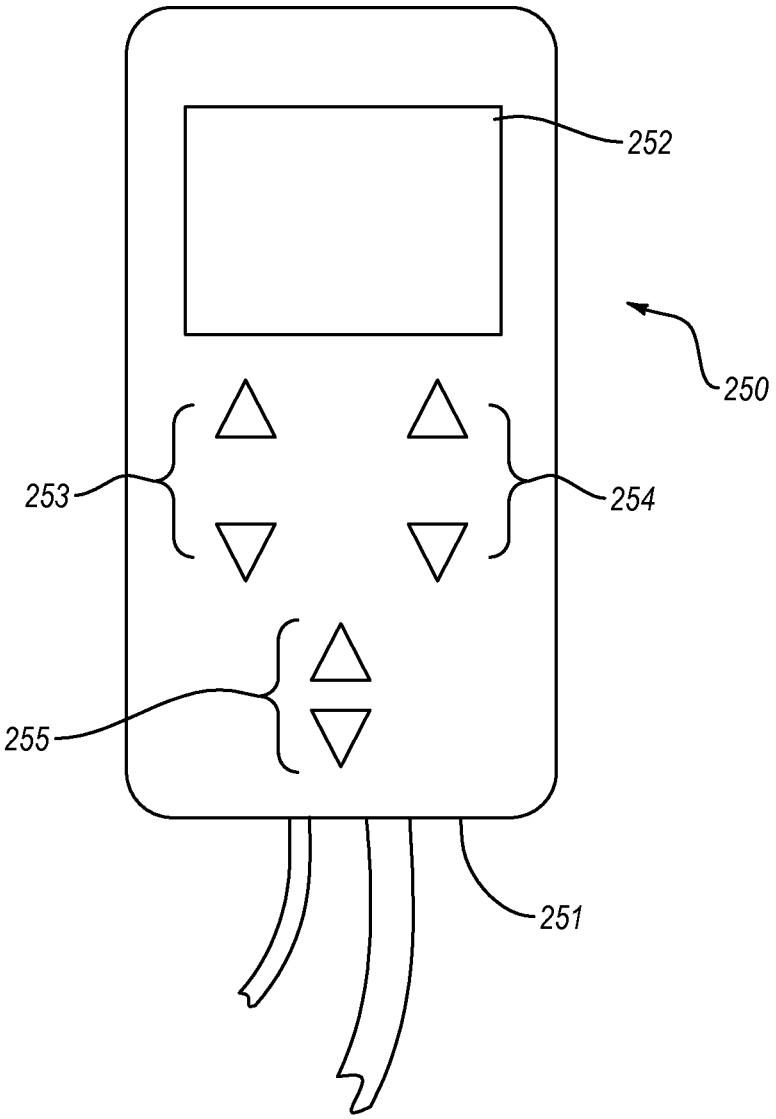
FIG. 31 is a detail view of the controller used to operate the orthopedic stretcher of FIG. 26.

As shown in FIG. 31, the controller 250 may have a suite of controls enabling a user to operate the orthopedic stretcher 199. The user operating the device may be the patient, but need not be. The controller 250 may have a controller body 251 that includes a display 252 to relay information to the user. Further, the controller 250 may have a set of slide motor controls 253 to operate the slide motor 243 and a set of base motor controls 254 to operate the base motor 204. In one embodiment, the controller 250 can include timer controls 255 so the user can apply the flexion or extension force to the patient's knee joint 108 for a known period of time.

In some embodiments, the controller 250 may be programmed with variable speed cycle controls to allow the orthopedic stretcher 199 to follow a predetermined speed. For instance, the variable speed cycle controls may speeds up movements of various parts of the orthopedic stretcher 199 in the middle of the cycle and slow down the speeds at the upper and/or lower bounds. By way of example, a patient may set the orthopedic stretcher 199 to move from about 0 degrees to about 120 degrees. When the orthopedic stretcher 199 is running, it may run at a high speed (e.g., 0.5 in/sec-1 in/sec) from about 20 degrees to about 100 degrees. From about 0 degrees to about 20 degrees and about 100 degrees to about 120 degrees, the orthopedic stretcher 199 may run at a slower speed (e.g., 0.25 in/sec-0.5 in/sec). This will allow patients to spend more time in the key ranges of flexion and extension and less time in the middle ranges where range of motion is no longer a problem.

In some embodiments, the base drive motor 204 and/or the slide motor 243 may include positional determining mechanisms for determining/tracking the position of the various movable components of the orthopedic stretcher 199. For instance, the base drive motor 204 and/or the slide motor 243 may include rotary encoders that count the number of revolutions of the motors to allow the orthopedic stretcher 199 to determine position of each of the components.

As can be seen in FIG. 32, the patient's leg 100 can be secured in the orthopedic stretcher 199. In particular, the patient's upper leg 102 can be secured to the upper leg support 220 using the upper leg support strap 222, and the patient's lower leg can be secured to the lower leg support 230 using the lower leg support strap 232.

Figure 33:
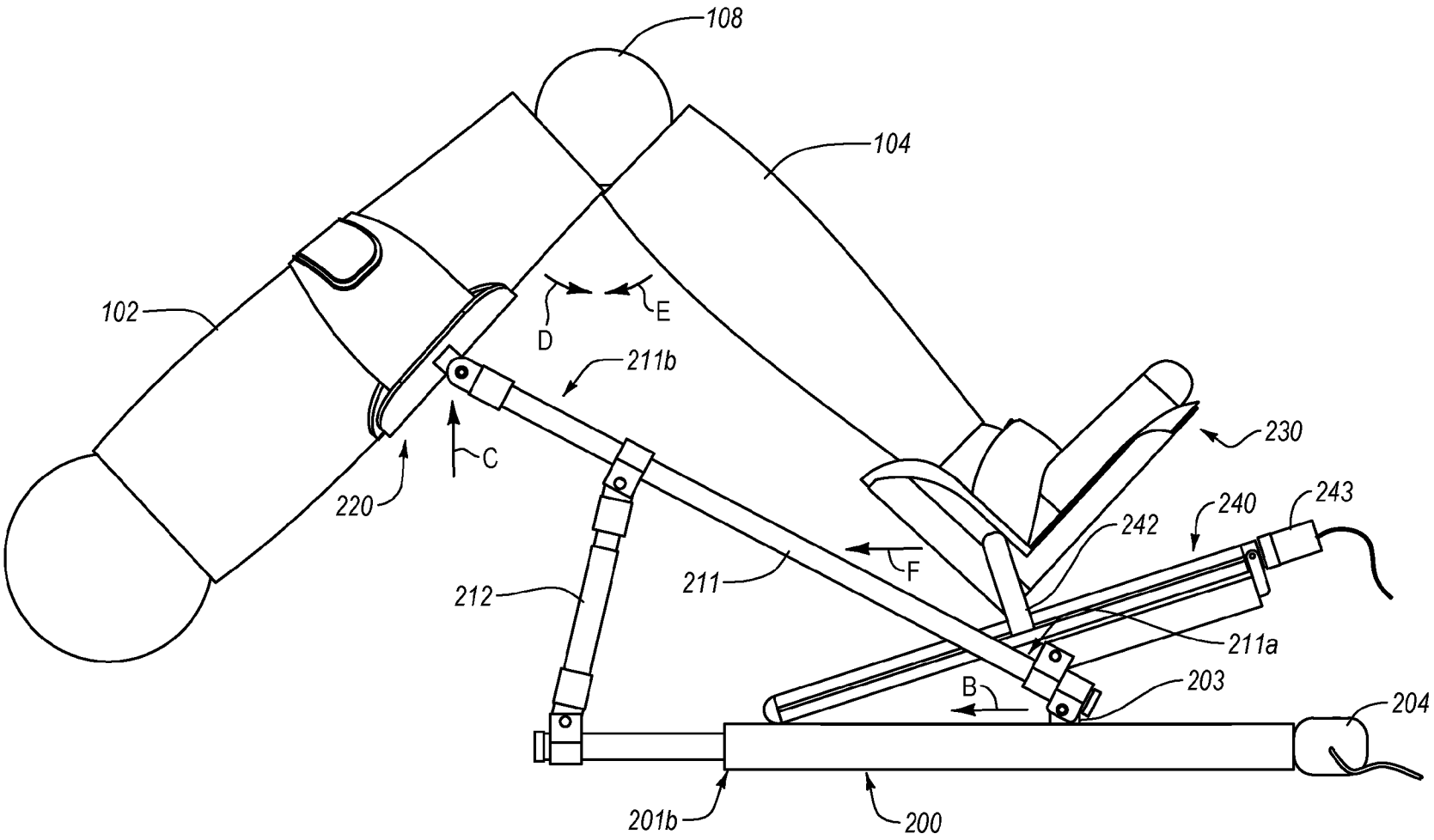
FIG. 33 is a side view of the orthopedic stretcher of FIG. 26 in use to apply a flexion force to a patient's leg.

Referring to FIGS. 27 and 33, in one embodiment, when the base drive motor 204 moves the base bracket 203 toward the distal end 201*b* of the base 201 (in the direction of arrow B), the proximal ends 21 1*a* of front support arms 211 move also, causing the angle of the front support rods 211 to increase relative to the base 200. This increase in angle relative to the base 200 drives the upper leg support 220 higher relative to the base 200 (in the direction of arrow C), moving the patient's upper leg 102 higher and to a greater angle relative to the base 200. Consequentially, an increase in the angle of the patient's upper leg 102 relative to the base 200 will create a corresponding increase in the angle of the patient's lower leg 104 relative to the base 200 if the lower leg support 230 remains stationary relative to the slide 240. The patient may also operate the slide motor 243 in conjunction with the base motor 204 in order to increase or decrease the flexion or extension (as indicated by arrows D, E, and F). Increasing the angles of the upper leg 102 and/or the lower leg 104 relative to the base 200, applies a flexion force to the patient's knee joint 108. It will be apparent to one skilled in the art that operating both the base motor 204 and the slide motor 243 may increase the range of motion of the orthopedic stretcher 199 and thus enable greater flexion of the patient's knee joint 108.

When the desired flexion force on the knee joint 108 is attained, the user can stop the base motor 204 and/or the slide motor 243, thereby stopping the rotation of the leadscrew 205 and translation of the base bracket 203 toward the distal end 201*b* of the base body 201 and/or the leadscrew 244 and translation of the slide bracket 242 down the slide body 241. Upon stopping the base motor 204 and/or the slide motor 243, the orthopedic stretcher 199 will remain in the current position. Once in position, the orthopedic stretcher 199 allows for the user to maintain a static flexion force until operating the base drive motor 204 and/or the slide motor 243 in the opposite direction to move the base bracket 203 toward the proximal end 201*a* of the base body 201 and/or the slide bracket 242 toward the proximal end 241*a* of the slide body 241, thereby reducing the angle of the front support rods 211 and of the upper leg 102 and lower leg 104 relative to the base 200.

Figure 34:
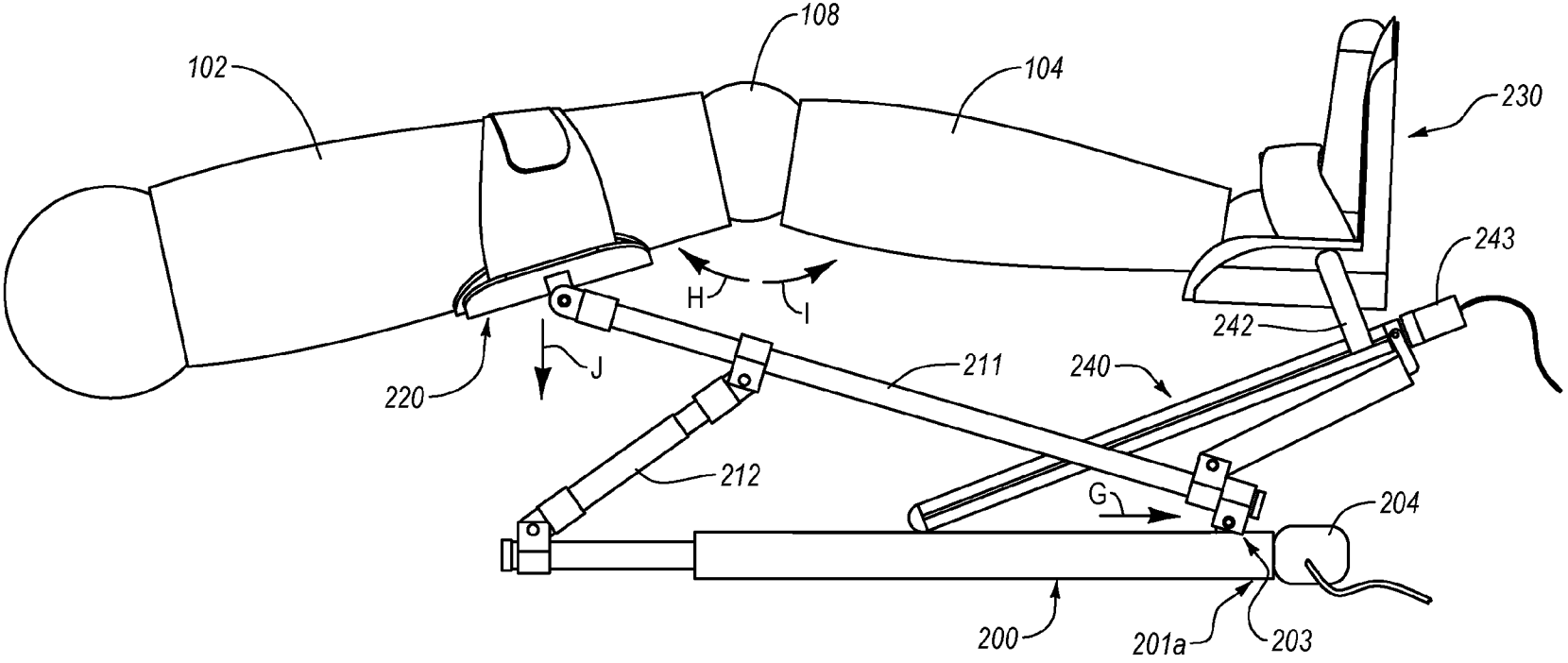
FIG. 34 is a side view of the orthopedic stretcher of FIG. 31 in use to apply an extension force to a patient's leg.
Figure 35:
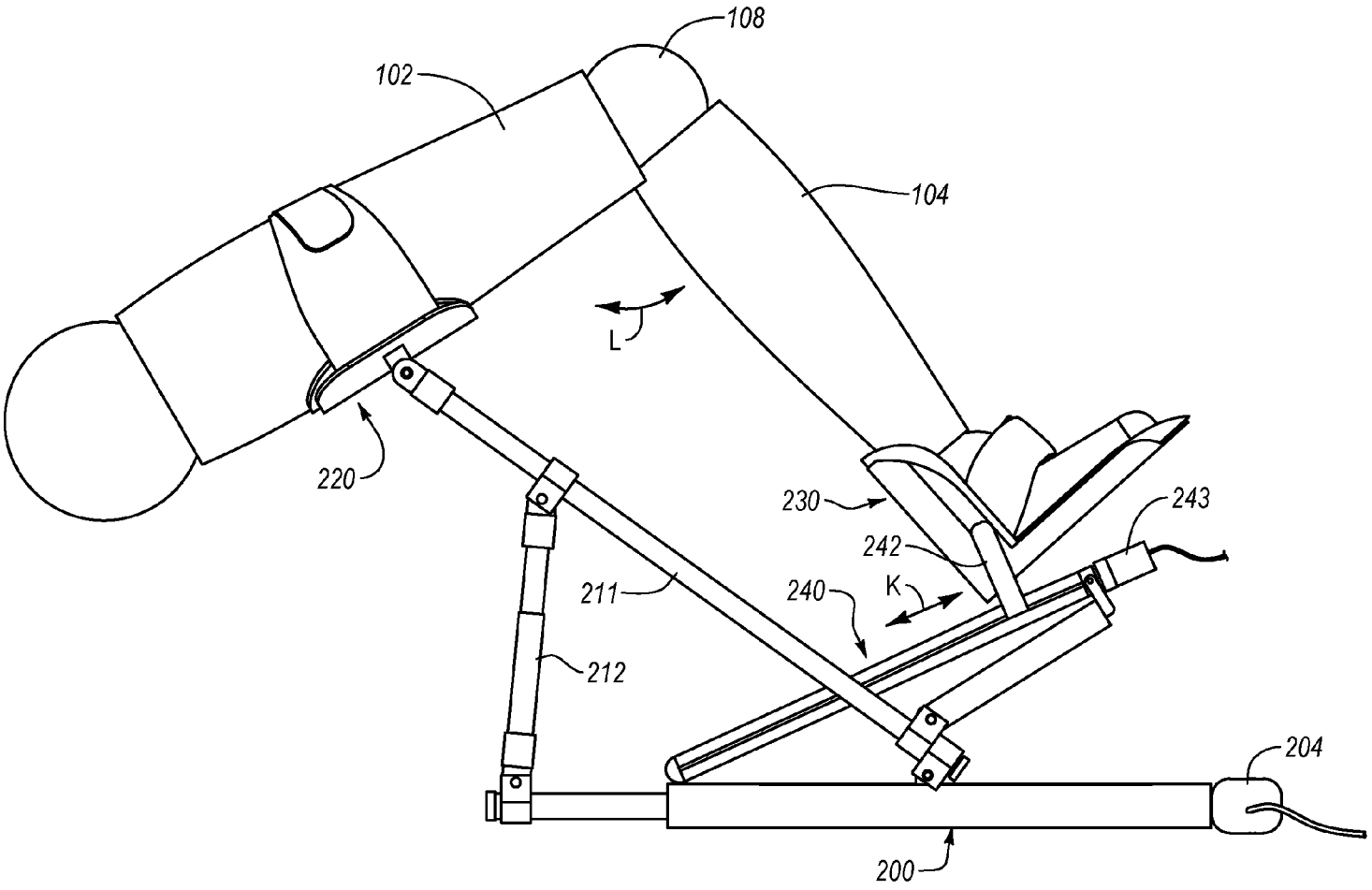
FIG. 35 is a side view of the orthopedic stretcher of FIG. 26 in use to release a flexion force from and/or apply an extension force to a patient's leg.

Directing attention now to FIG. 34, the base drive motor 204 can be operated to move the base bracket 203 (in the direction of arrow G) towards the proximal end 201*a* of the base body 201 to decrease the angle of the front support rods 211 relative to the base 200. As a result, the angle of the patient's upper leg 102 will also decrease (as indicated by arrows H and I) as the height of the upper leg support 220 decreases (as indicated by arrow J, and the orthopedic stretcher 199 will begin to apply an extension force to the patient's knee joint 108 if the lower leg support 230 remains stationary relative to the slide 240 or is moved toward the proximal end 241*a* of the slide 240. The user may also operate the slide motor 243 in conjunction with the base motor 204 in order to increase or decrease the flexion or extension allied to the knee joint 108. Decreasing the angles of the upper leg 102 and/or the lower leg 104, relative to the base 200, applies an extension force to the patient's knee joint 108. When the desired extension force on the knee joint 108 is attained, the user can stop the base motor 204 and/or the slide motor 243, thereby stopping the rotation of the base leadscrew 205 and translation of the base bracket 203 toward the proximal end 201*a* of the base body 201 and/or the slide leadscrew 244 and translation of the slide bracket 242 toward to proximal end 241*a* of the slide 240. As indicated previously, it will be apparent to one skilled in the art that use of both the slide motor 243 and the base motor 204 may increase the range of motion of the orthopedic stretcher 199.

Upon stopping the slide motor 243 and the base motor 204, the orthopedic stretcher 199 will remain in the current position. Once in position, the orthopedic stretcher 199 allows for the user to maintain a static extension force until the base drive motor 204 and/or the slide motor 243 are operated in the opposite direction(s) to move the base bracket 203 toward the distal end 201*b* of the base body 201 and/or the slide bracket 242 toward the distal end 241*b* of the slide 240, thereby reducing the angle of the front support rods 211 and of the upper leg 102 and lower leg 104 relative to the base 200.

In light of the foregoing, it is readily apparent that the angle of the lower leg 104 may be changed relative to the base 200 using the slide motor 243 and slide leadscrew 244. More specifically, and referring to FIG. 35, the user can use the slide motor 243 and slide leadscrew 244 to move the slide bracket 242 forward and back along the slide body 241 (as indicated by arrow K), thereby changing the position of the lower leg support 230. This adjustability grants the user greater control over the flexion and extension forces applied to the knee joint 108 by altering the position of the lower leg 104 (as indicated by arrow L) independent of, or in conjunction with, changing the position of the upper leg 102.

In another embodiment, the orthopedic stretcher 199 includes a device to measure the angle of the front support arms 211 relative to the base 200. In one embodiment, the angle is measured by a goniometer attached to the base 200 at the front support hinge 214. In one embodiment, the goniometer is detachable. In another embodiment, the goniometer is integrally formed on the base body 201. In yet another embodiment, the base 200 also includes a force transducer to determine the force applied to the knee joint 108.

The present invention may be embodied in other specific forms without departing from its spirit or essential characteristics. The described embodiments are to be considered in all respects only as illustrative and not restrictive. The scope of the invention is, therefore, indicated by the claims and not the foregoing description. All changes which come within the meaning and range of equivalency of the claims are to be embraced within their scope.

What is claimed is:

1. An apparatus for alternately applying flexion and extension forces to a patient's leg, the patient's leg including an upper leg and a lower leg pivotally connected at a knee joint, the apparatus comprising:

a base;

a first leg support for engaging the patient's upper leg, the first leg support being pivotally connected to the base;

a second leg support for engaging the patient's lower leg, the second leg support being linked to the first leg support;

at least one front support rod connected between the base and the first leg support;

at least one rear support rod connected directly to and between the at least one front support rod and the base, the at least one rear support rod is selectively extendable and retractable, such that a length of the at least one rear support rod increases and decreases as the at least one rear support rod extends and retracts, respectively;

a first motor connected to and configured to move the first leg support and second leg support relative to the base in a horizontal direction;

a second motor connected to and configured to move the second leg support relative to the first leg support in the horizontal direction, wherein movement of the second leg support by the second motor does not move the first leg support; and wherein the second motor is configured to move the second leg support closer to the first leg support and configured to move the second leg support further from the first leg support to extend or flex the knee joint by applying an extension force or flexion force to the knee joint.

2. The apparatus of claim 1, wherein the first motor is operably connected to the first leg support by a rotatable leadscrew.

3. The apparatus of claim 1, further comprising a controller to control the first motor and second motor.

4. The apparatus of claim 1, wherein the second leg support comprises a boot for restraining the lower leg at a foot or ankle of the patient's leg.

5. The apparatus of claim 1, wherein the at least one front support rod is pivotally connected to each of the first leg support and the base.

6. The apparatus of claim 1, wherein the at least one rear support rod is pivotally connected to each of the at least one front support rod and the base.

7. The apparatus of claim 1, wherein the first leg support and the second leg support both move in a first horizontal direction when the first motor moves the first leg support and the second leg support, the first leg support and second leg support moving further apart to extend the patient's leg when the first leg support and the second leg support both move in a second horizontal direction.

8. The apparatus of claim 7, wherein the first leg support and the second leg support both move in a second horizontal direction when the first motor moves the first leg support and the second leg support, the first leg support and second leg support moving closer together to bend the patient's leg when the first leg support and second leg support both move in the second horizontal direction.

9. An apparatus for alternately applying flexion and extension forces to a patient's leg, the patient's leg including an upper leg and a lower leg pivotally connected at a knee joint, the apparatus comprising:

a base;

a plurality of support rods linked to the base, the plurality of support rods comprising:

at least one front support rod pivotally connected to the base, the at least one front support rod having a proximal end and a distal end; and a support bracket connected directly to the at least one front support rod;

a first leg support selectively securable to the patient's upper leg and pivotally connected to the at least one front support rod, such that the at least one front support rod is connected between the base and the first leg support and such that the at least one front support rod connects the first leg support to the base;

a slide pivotally connected to the support bracket, the slide having a proximal end and a distal end;

a second leg support selectively securable to the patient's lower leg and movably connected to the slide;

a first drive mechanism that selectively moves the first leg support and the second leg support relative to the base in a horizontal direction;

a second drive mechanism that selectively moves the second leg support relative to the first leg support in the horizontal direction to extend or flex the patient's leg at the knee joint by applying an extension or flexion force at the knee joint; wherein the base comprises a base bracket that is selectively movable between a first end and a second end of the base by the first drive mechanism; and wherein the second leg support is selectively movable between the proximal and distal ends of the slide, wherein movement of the second leg support toward the proximal end of the slide moves the second leg support further away from the first leg support, and wherein movement of the second leg support toward the distal end of the slide moves the second leg support closer to the first leg support.

10. The apparatus of claim 9, wherein the at least one front support rod is pivotally connected to the base bracket at the proximal end of the at least one front support rod, such that movement of the base bracket toward the first end of the base causes the first leg support to pivot toward the first end of the base.

11. The apparatus of claim 10, wherein movement of the base bracket toward the second end of the base causes the first leg support to pivot away from the first end of the base.

12. The apparatus of claim 9, wherein the support bracket is pivotally connected to the at least one front support rod.

13. The apparatus of claim 9, further comprising at least one rear support rod pivotally connected between the base and the at least one front support rods.

14. The apparatus of claim 13, wherein the at least one rear support rod is selectively extendable and retractable, such that a length of the at least one rear support rod increases and decreases as the at least one support rod extends and retracts, respectively, wherein pivoting of the at least one front support rod in a first direction causes the at least one rear support rod to retract, and wherein pivoting of the at least one front support rod in a second direction causes the at least one rear support rod to extend.

15. An apparatus for alternately applying flexion and extension forces to a patient's leg, the patient's leg including an upper leg and a lower leg, the upper and lower legs being pivotally connected at a knee joint, the apparatus comprising:

a base;

a plurality of support arms connected to the base, the plurality of support arms comprising:

a first support arm; and a second support arm pivotally connected to the first support arm;

a third support arm connected directly to and between the first support arm and the base, the third support arm being selectively extendable and retractable, such that a length of the third support arm increases and decreases as the third support arm extends and retracts, respectively;

a first leg support that is selectively securable to the patient's upper leg and pivotally connected to the first support arm, such that the first support arm is connected between the base and the first leg support and such that the first support arm connects the first leg support to the base; and a second leg support that is selectively securable to the patient's lower leg and pivotally connected to the second support arm, a first drive mechanism connected to the first leg support and the second leg support, the first drive mechanism being configured to move the first leg support and the second leg support in a horizontal direction relative to the base;

a second drive mechanism connected to the second leg support and being configured to move the second leg support in the horizontal direction relative to the base and the first leg support, wherein the second drive mechanism is configured to move the second leg support further from the first leg support to extend or flex the knee joint by applying an extension or flexion force to the knee joint;

wherein the first drive mechanism is configured to move both the first leg support and the second leg support in a first horizontal direction, and wherein the second leg support moves further away from the first leg support to apply an extension force to the patient's leg, and wherein the first drive mechanism is configured to move both the first leg support and the second leg support in an opposing second horizontal direction, and wherein the second leg support moves closer to the first leg support to apply a flexion force to the patient's leg.

16. The apparatus of claim 15, further comprising a slide connected to the second support arm, wherein the second drive mechanism is operably connected to the slide and the second leg support is movably connected to the slide such that the second leg support is selectively movable between a proximal end and a distal of the slide.

17. The apparatus of claim 15, wherein each of the first leg support and the second leg support is selectively movable in a first vertical direction and a second vertical direction relative to one another.

* * * * *